US007326080B2

(12) United States Patent
Sakamoto et al.

(10) Patent No.: US 7,326,080 B2
(45) Date of Patent: Feb. 5, 2008

(54) CONNECTOR

(75) Inventors: Nobuyuki Sakamoto, Shizuoka (JP); Kazuki Zaitsu, Kanagawa (JP); Kei Sato, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/707,092

(22) Filed: Feb. 16, 2007

(65) Prior Publication Data

US 2007/0197090 A1 Aug. 23, 2007

(30) Foreign Application Priority Data

Feb. 22, 2006 (JP) ..... 2006-045810
Nov. 10, 2006 (JP) ..... 2006-305450

(51) Int. Cl.
*H01R 13/40* (2006.01)

(52) U.S. Cl. ..... 439/587

(58) Field of Classification Search ..... 439/587, 439/701, 274, 275, 589
See application file for complete search history.

(56) References Cited

U.S. PATENT DOCUMENTS 6,116,952 A * 9/2000 Nakata ..... 439/587
6,468,113 B1 * 10/2002 Murakami et al. ..... 439/752
6,638,108 B2 * 10/2003 Tachi ..... 439/595
2005/0048837 A1 * 3/2005 Ichida et al. ..... 439/595
2007/0004274 A1 * 1/2007 Tabata et al. ..... 439/540.1
2007/0037436 A1 * 2/2007 Iwahori ..... 439/422

FOREIGN PATENT DOCUMENTS

JP 2000-294336 10/2000

* cited by examiner

*Primary Examiner*—Phuong Dinh
(74) *Attorney, Agent, or Firm*—Kratz, Quintos & Hanson, LLP

(57) ABSTRACT

The connector includes: a connector housing for receiving terminal fittings; a rear holder which includes a plurality of holders made of synthetic resin for positioning an electric wire attached to the terminal fitting between the holders, the rear holder being mounted to the connector housing when the holders are attached to one another; and a sealing member which includes a plurality of sealing pieces made of resilient material for positioning the electric wire between the sealing pieces, the sealing member maintaining a water-proof characteristic between the sealing member and the electric wires when the holders are attached to the respective sealing pieces, the holders are attached to one another, and the rear holder is mounted to the connector housing.

10 Claims, 21 Drawing Sheets

CONNECTOR

BACKGROUND OF THE INVENTION (1) Field of the Invention

The present invention relates to a connector for use in connecting electric wires and for maintaining a waterproof property between the connector and the electric wires.

(2) Description of the Related Art

Various electronic instruments are mounted on a motor vehicle as a mobile unit. The motor vehicle is provided with a wiring harness for transmitting electric power and control signals to the electronic instruments. The wiring harness includes a plurality of electric wires and connectors. The electric wire is a so-called coated electric wire including an electrically conductive core wire and an electrically insulating coating which coats the core wire.

As the connector described above, for example, a connector disclosed in Japanese Patent Application Laid-Open No. 2000-294336 is used. The connector disclosed in Japanese Patent Application Laid-Open No. 2000-294336 includes a connector housing, sealing member and so on. The connector housing includes a tube-shaped outer case and a plurality of plate-shaped housings. The plate-shaped housing is provided with a terminal receiving groove for receiving a terminal fitting to which an electric wire is attached.

The sealing member includes a plurality of sheet-shaped sealing bodies each made of resilient material such as rubber. The sheet-shaped sealing body is attached to the plate-shaped housing so as to maintain a waterproof property between the sheet-shaped sealing body and the electric wire, which is attached to the terminal fitting received in the terminal receiving groove of the plate-shaped housing.

The connector described above is assembled as follows. First, each terminal fitting, to which the electric wire is attached, is received in the terminal receiving groove of the plate-shaped housing and the sheet-shaped sealing bodies are attached to the respective plate-shaped housings. Then, the plate-shaped housings are assembled with each other and the assembled plate-shaped housings are received in the outer case. Thus, the connector described above is assembled and coupled with a mating connector. In the connector thus assembled, the sheet-shaped sealing body maintains a waterproof property between the sheet-shaped sealing body and the electric wire so as to prevent liquid such as water from entering into the terminal receiving groove after passing along the electric wire.

As for the connector disclosed in Japanese Patent Application Laid-Open No. 2000-294336, since the sheet-shaped sealing bodies, each made of rubber or the like, abut against each other when the plate-shaped housings are assembled with each other, therefore the plate-shaped housings must be assembled with each other opposing against resilient restoring force of the sheet-shaped sealing body. Further, in the connector disclosed in Japanese Patent Application Laid-Open No. 2000-294336, there is no means provided for fixing the sheet-shaped sealing body on the plate-shaped housing.

Therefore, when the plate-shaped housings are assembled with each other, there might be a problem that the sheet-shaped sealing body comes off from the plate-shaped housing. Therefore, as for the connector disclosed in Japanese Patent Application Laid-Open No. 2000-294336, it is difficult to assemble the plate-shaped housings with each other on a condition that the sheet-shaped sealing body never comes off from the plate-shaped housing. That is, it is difficult to assemble the connector.

SUMMARY OF THE INVENTION

It is therefore an objective of the present invention to solve the above problem and to provide a connector, which can be easily assembled.

In order to attain the above objective, the present invention is to provide a connector including:

a connector housing for receiving terminal fittings;

a rear holder which includes a plurality of holders made of synthetic resin for positioning an electric wire attached to the terminal fitting between the holders, the rear holder being mounted to the connector housing when the holders are attached to one another; and a sealing member which includes a plurality of sealing pieces made of resilient material for positioning the electric wire between the sealing pieces, the sealing member maintaining a waterproof characteristic between the sealing member and the electric wires when the holders are attached to the respective sealing pieces, the holders are attached to one another, and the rear holder is mounted to the connector housing.

With the construction described above, the sealing pieces of the sealing member are in advance attached to the respective holders of the rear holders. Therefore, when the holders are assembled with each other, the sealing piece can be prevented from coming off from the holder even if resilient restoring force of the sealing piece takes place. Therefore, the rear holder can be easily assembled, that is, the connector can be easily assembled.

A holder base positioned at an end of the rear holder and a laminated holder to be laminated on the holder base are provided as the holders.

With the construction described above, since the holder base and the laminated holder are provided as the holders, therefore the rear holder can securely position an electric wire between the holders. Therefore, the electric wire can be positioned between the sealing pieces, so that liquid such as water can be securely prevented from entering into the connector housing.

The holder base includes a connecting part and a rail part projecting in a laminating direction of the laminated holder from both ends of the connecting part, while the rear holder includes a guiding part which allows the laminated holder to be movable along a longitudinal direction of the rail part.

With the construction described above, the laminated holder is slid along the rail part of the holder base so that the rear holder is assembled. Therefore, the rear holder can be easily assembled.

The rear holder includes an engaging part for engaging an end part of the rail part with a laminated holder, said end part being situated away from the connecting part, and said laminated holder being situated farthest away from the connecting part among the laminated holders.

With the construction described above, the rear holder can be assembled by engaging one of the laminated holders with an end part of the rail part. Therefore, the rear holder can be easily assembled.

The sealing member includes: a plurality of the sealing pieces; and reinforcing members each made of synthetic resin and embedded in a cavity formed in the sealing piece.

With the construction described above, since the reinforcing member is embedded in the sealing piece, therefore the sealing piece is hardly deformed resiliently (i.e. being hardened), so that a waterproof characteristic between the sealing piece and the electric wire can be securely maintained. Therefore, liquid such as water can be securely prevented from entering into the connector.

The sealing piece includes a groove having a semicircular shape in cross section for positioning an electric wire inside, the reinforcing member includes a groove-shaped part formed in accordance with an inner shape of the groove, and the groove-shaped part is parallel to an inner surface of the groove so as to closely come in contact with the sealing piece when the reinforcing member is press-fit into the cavity.

With the construction described above, since the reinforcing member includes a groove-shaped part formed in accordance with an inner shape of the groove of the sealing piece, therefore force that the inner surface of the groove of the sealing piece presses the electric wire is uniform in a circumferential direction of the groove. Therefore, a waterproof characteristic between the sealing piece and the electric wire can be more securely maintained. Therefore, liquid such as water can be securely prevented from entering into the connector.

The reinforcing member is integrally formed with the sealing piece.

With the construction described above, since the reinforcing member is integrally formed with the sealing piece, therefore the reinforcing member closely comes in contact with the sealing piece. Therefore, the sealing piece can securely prevent liquid such as water from entering into the connector.

The sealing member includes a fixing part for fixing the reinforcing members to each other.

With the construction described above, since the sealing member includes a fixing part for fixing the reinforcing members to each other, therefore the fixing part maintains a distance between the sealing pieces constant. Therefore, a waterproof characteristic between the sealing piece and the electric wire can be more securely maintained. Therefore, liquid such as water can be more securely prevented from entering into the connector.

The rear holder includes a holder positioning means for positioning the holders piled up with one another.

With the construction described above, since the holder includes a holder positioning means for positioning mutually the holders lying on top of one another, therefore by the holder positioning means, the holders, that is, the sealing pieces mutually can be always maintained to have a constant positional relation between them. Therefore, a waterproof characteristic between the sealing piece and the electric wire can be securely maintained. Therefore, liquid such as water can be more securely prevented from entering into the connector.

The rear holder includes a holder fixing means for fixing the holders piled up with one another.

With the construction described above, since the rear holder includes a holder fixing means for fixing mutually the holders lying on top of one another, therefore by the holder fixing means, the holders, that is, the sealing pieces can be securely fixed to each other. Therefore, a waterproof characteristic between the sealing piece and the electric wire can be securely maintained. Therefore, liquid such as water can be more securely prevented from entering into the connector.

DESCRIPTION OF THE PREFERRED EMBODIMENTS

In the following, a connector according to the first preferred embodiment of the present invention will be explained with reference to FIGS. 1-17.

Figure 1:
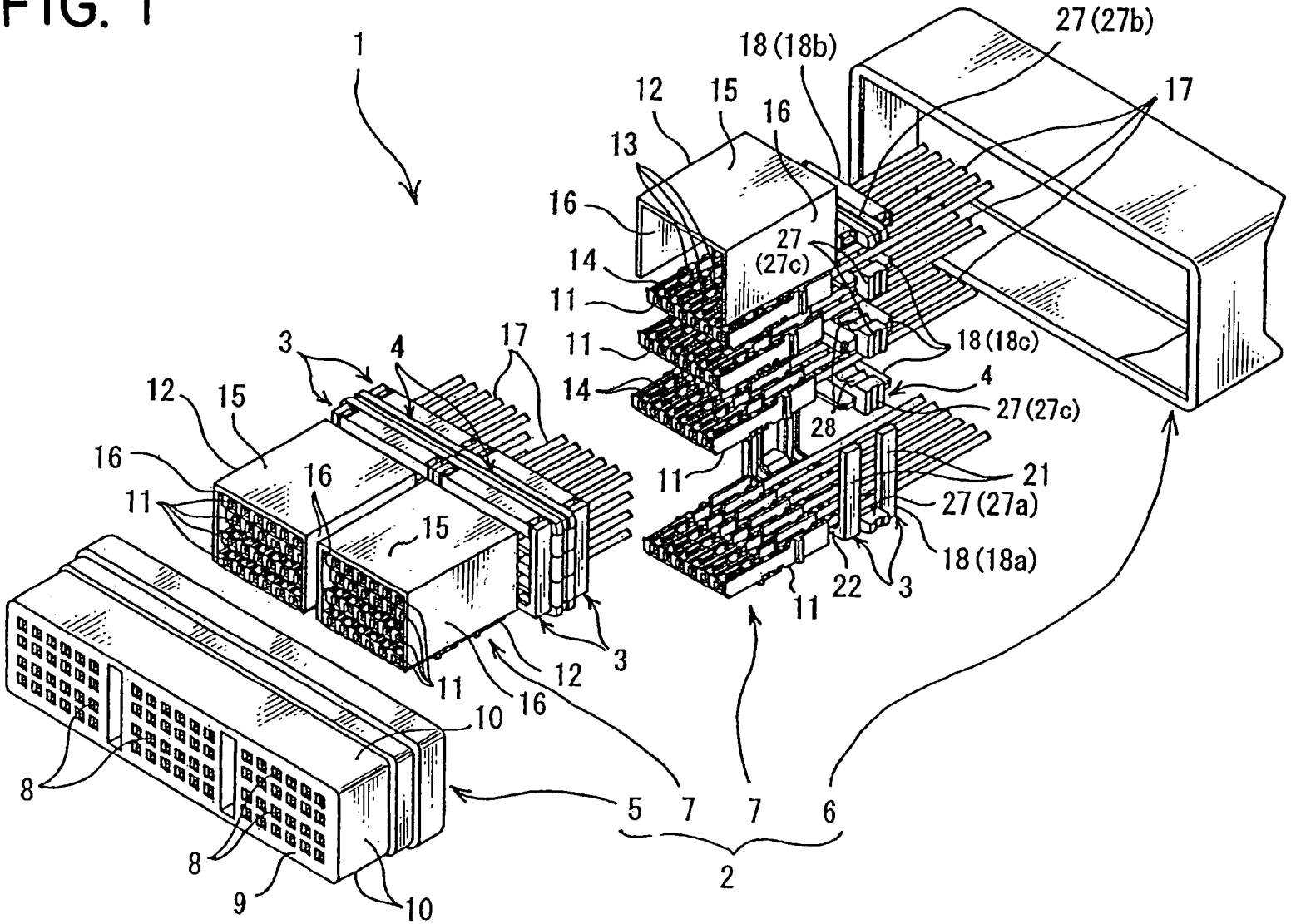
FIG. 1 is an exploded perspective view of a connector according to the first preferred embodiment of the present invention.
Figure 2:
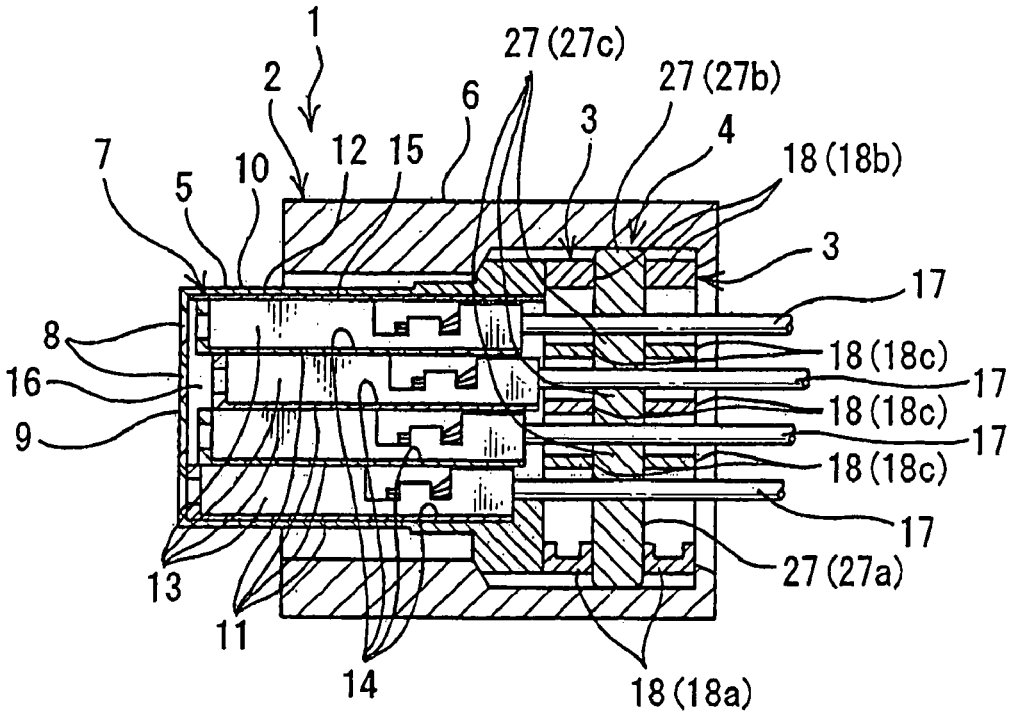
FIG. 2 is a cross sectional view of the connector shown in FIG. 1.

As shown in FIGS. 1 and 2, a connector 1 includes a connector housing 2, a plurality pairs of rear holders 3, and a plurality of sealing members 4. The connector housing 2 includes a housing body 5, outer case 6, and a plurality of connector blocks 7.

The housing body 5 is made of electrically insulating synthetic resin and formed in a tube-shape, including: a facing wall 9 having a plurality of holes 8 through which male tabs of male terminals of a mating connector are passed, said mating connector is to be coupled with the connector 1; and a plurality of peripheral walls 10 standing up from an outer edge of the facing wall 9. A space inside the housing body 5 is divided into plural parts (three parts in an example shown in the figure).

The outer case 6 is made of electrically insulating synthetic resin and formed in a tube-shape. The outer case 6 receives the housing body 5 and connector blocks 7 inside and is fixed to the housing body 5.

In an example shown in the figure, there are three connector blocks 7. As shown in FIGS. 1 and 2, the connector block 7 includes a plurality of plate-shaped housings 11 and one cover member 12. In an example shown in the figure, one connector block 7 has four plate-shaped housings 11. The plate-shaped housing 11 is made of electrically insulating synthetic resin and formed in a flat plate-shape. The plate-shaped housing 11 includes a plurality of terminal receiving grooves 14 for receiving terminal fittings 13 (shown in FIG. 2). A plurality of the terminal receiving grooves 14 are formed hollow from an outer surface of the plate-shaped housing 11 and arranged in parallel to one another. A plurality of the plate-shaped housings 11 lie on top of one another in parallel.

The cover member 12 is made of electrically insulating synthetic resin and formed in a C-shape, including a flat top wall 15 and standing walls 16 standing up from respective outer edges of the top wall 15. The cover member 12 is piled on the plate-shaped housing 11 in such a manner that the top wall 15 closes a terminal receiving groove 14 of the plate-shaped housing 11, which is situated at the highest among a plurality of the plate-shaped housings 11. The cover member 12 positions a plurality of the plate-shaped housings 11 between the pair of the standing walls 16 and is fixed to these plate-shaped housings 11. Thus, the plate-shaped housings 11, each of which receives the terminal fitting 13 attaching an electric wire 17 thereto in the terminal receiving groove 14, are piled on one another, the plate-shaped housings 11 are covered with the cover member 12, and the plate-shaped housings 11 are fixed to the cover member 12 each other, thereby the connector block 7 is assembled.

Figure 3:
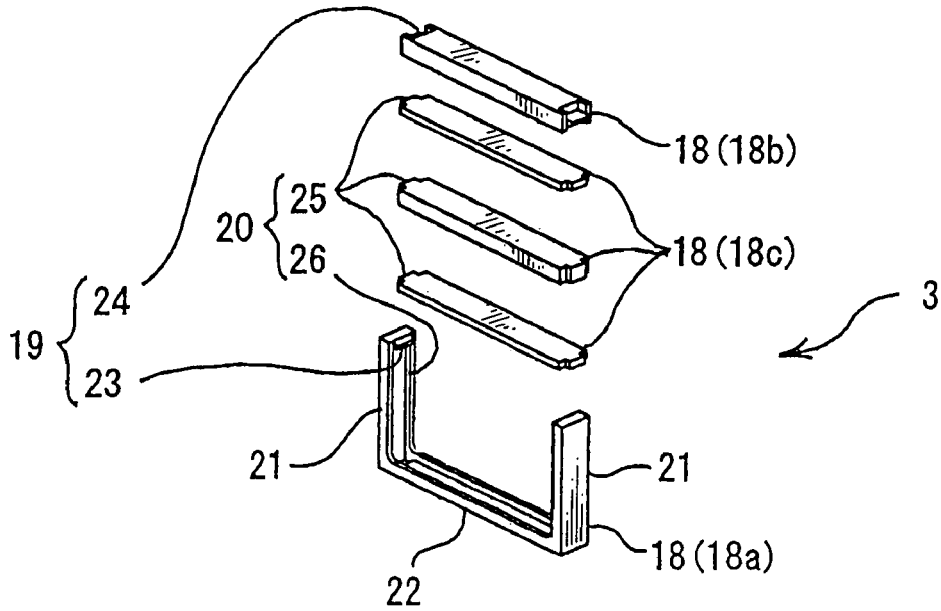
FIG. 3 is an exploded perspective view of a rear holder of the connector shown in FIG. 1.

The rear holder 3 is made of electrically insulating and hard (i.e. hardly being resiliently deformed) synthetic resin. One connector block 7 includes a pair of the rear holders 3. As shown in FIG. 3, the rear holder 3 includes a plurality of holders 18, an engaging part 19, and a guiding part 20. In an example shown in the figure, the rear holder 3 includes five holders 18.

Figure 4:
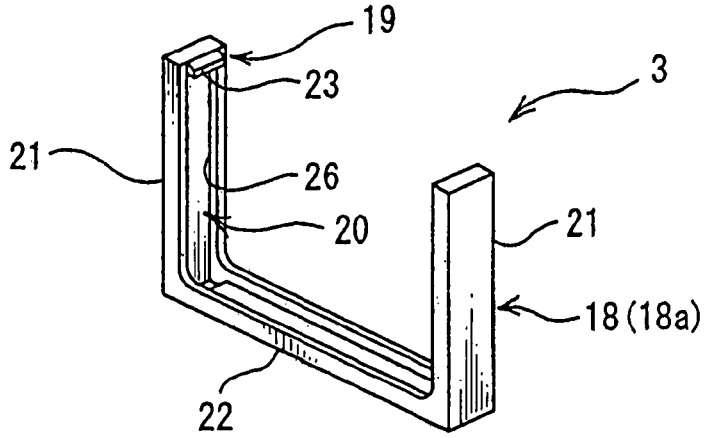
FIG. 4 is a perspective view of a holder of the rear holder shown in FIG. 3.
Figure 5:
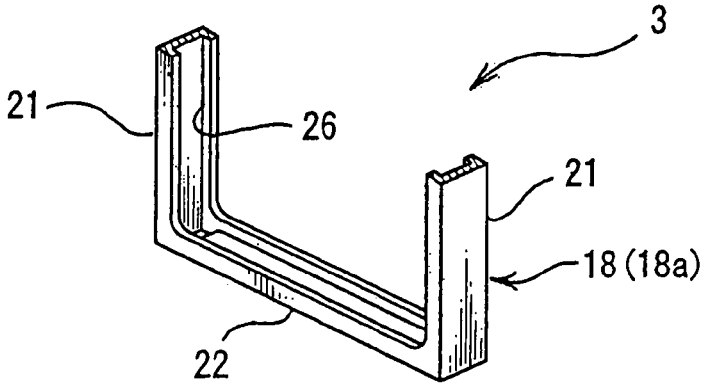
FIG. 5 is a perspective view of the holder shown in FIG. 4 partially illustrating with a section.

When one holder 18 (hereinafter, 18*a*; corresponding to the holder base) out of a plurality of the holders 18 is piled on another holder 18, said one holder 1-8*a* is positioned at an end of the rear holder 3. As shown in FIGS. 4 and 5, the one holder 18*a* includes a pair of rail parts 21 arranged in parallel to each other and a bar-shaped connecting part 22 for connecting ends of the rail parts 21 to each other. The one holder 18*a* is formed in a C-shape. The rail part 21 projects from an end of the connecting part 22 in a piling direction of the other holders 18. Each rail part 21 is formed in a shape of a bar extending straight. The rail parts 21 in a pair thereof are arranged in parallel to each other having a distance therebetween.

Figure 10:
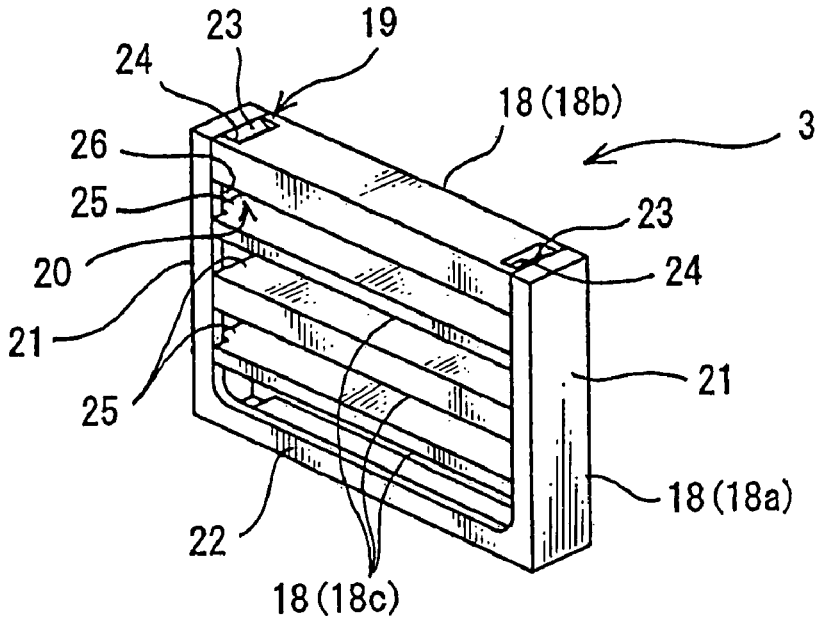
FIG. 10 is a perspective view of the rear holder shown in FIG. 3.
Figure 11:
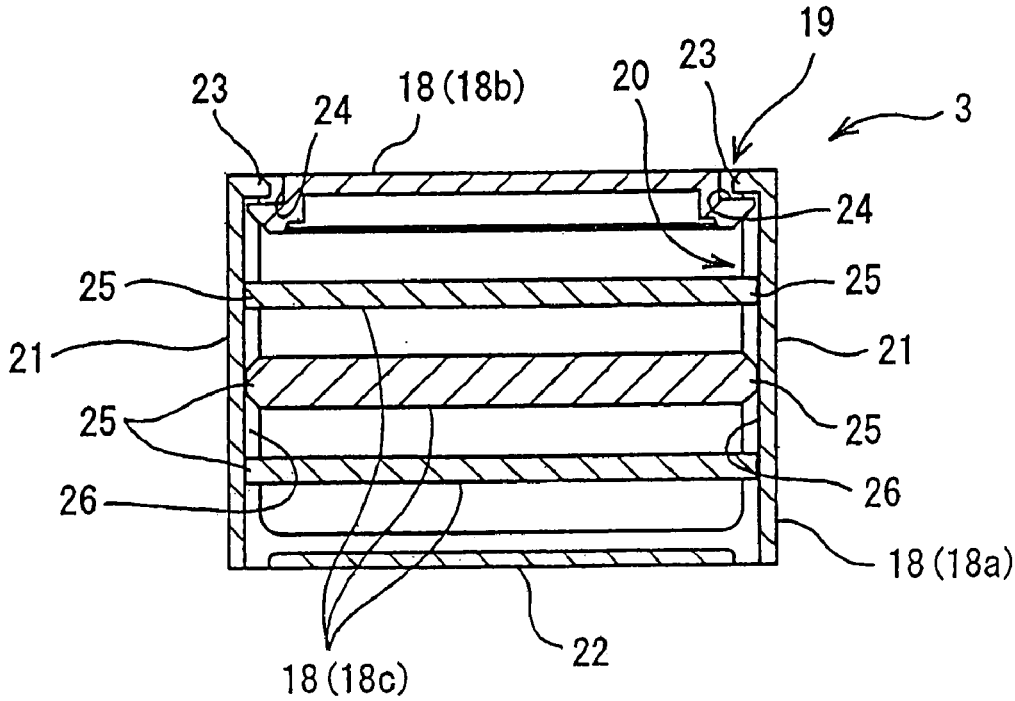
FIG. 11 is a cross sectional view of the rear holder shown in FIG. 10.

Each of the other four holders 18 (corresponding to the laminated holders) is formed in a shape of a belt extending straight. As shown in FIGS. 10 and 11, these four holders 18 are arranged between the pair of the rail parts 21, being in parallel to the connecting part 22. The four holders 18 are arranged in parallel to one another having a distance therebetween and piled on the one holder 18*a* as the holder base.

As shown in FIGS. 3 and 11, the engaging part 19 includes: an engaging projection 23 formed at an opposite end of the pair of the rail parts 21 (i.e. an end situated away from the connecting part 22); and engaging recess 24 formed at an end of the holder 18 (hereinafter, 18*b*) in the longitudinal direction, said holder 18*b* being situated farthest away from the connecting part 22 out of the four holders 18. That is, the engaging part 19 is formed at the opposite end of the rail part 21 and at both ends of the holder 18*b*. The engaging projection 23 is formed projecting from the opposite end of the rail part 21 in a direction in which the pair of the rail parts 21 approach each other. The engaging recess 24 is formed hollow from an upper surface situated away from the connecting part 22 of the holder 18*b*, at both ends of the holder 18*b* in the longitudinal direction thereof. When the engaging projection 23 enters in the engaging recess 24, the engaging part 19 engages both ends of the holder 18 and the opposite end of the rail part 21 with each other.

The guiding part 20 includes: a guiding projection 25 (shown in FIG. 6) formed at both ends of the other holder 18 (hereinafter, 18*c*) in the longitudinal direction, said other holders 18*c* being the holders 18 except the holders 18*a* and 18*b*; and a guiding groove 26 (shown in FIGS. 4 and 5) formed to the pair of the rail parts 21. That is, the guiding part 20 is provided to the other holders 18*c* and to the rail parts 21.

Figure 6:
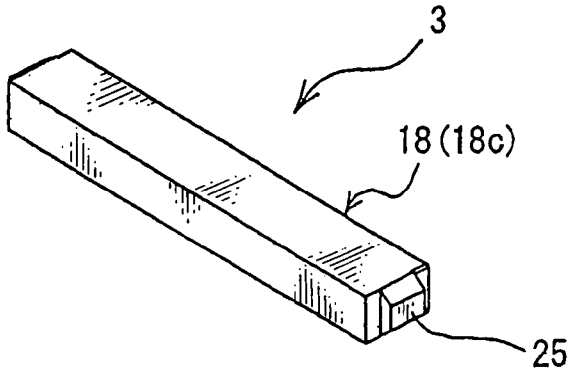
FIG. 6 is a perspective view illustrating another holder of the rear holder shown in FIG. 3.

As shown in FIG. 6, the guiding projection 25 is formed projecting from both ends of the holder 18*c* in the longitudinal direction thereof. Each guiding groove 26 is formed hollow from a corresponding facing surface of the pair of the rail parts 21. The guiding groove 26 extends along the longitudinal direction of the rail part 21 and formed for a whole length of the rail part 21. By the guiding groove 26, the rail part 21 is formed in a C-shape in section as shown in FIG. 5. When the guiding part 20 positions the guiding projection 25 in the guiding groove 26, the guiding part 20 supports the other holders 18*c* movable along the longitudinal direction of the guiding groove 26, that is, along the longitudinal direction of the rail part 21.

Figure 7:
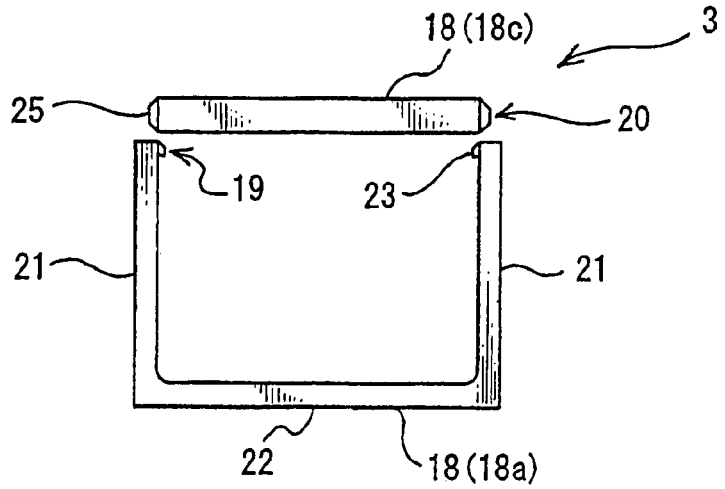
FIG. 7 is a front view illustrating a state before the other holder shown in FIG. 3 is attached to the holder shown in FIG. 4.
Figure 8:
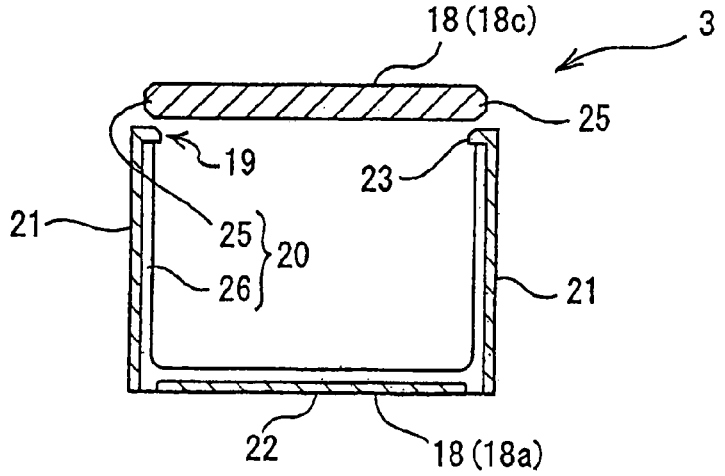
FIG. 8 is a cross sectional view of the holder shown in FIG. 7.
Figure 9:
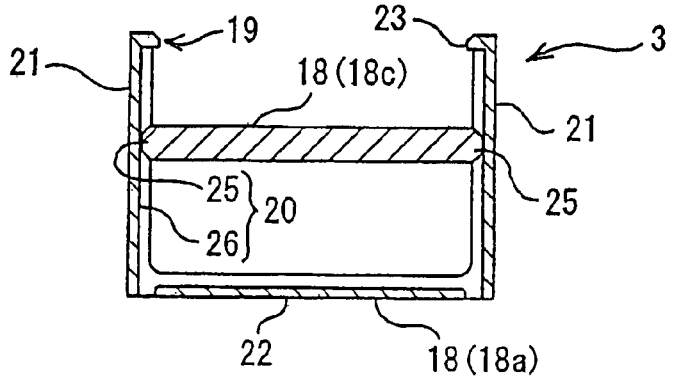
FIG. 9 is a cross sectional view illustrating a state when the holders shown in FIG. 8 are assembled with each other.

As shown in FIGS. 7 and 8, as for the rear holder 3, the connecting part 22 of the one holder 18*a* and the other holders 18*c* are arranged in parallel to one another and thereafter, the other holders 18*c* are press-fit into between the pair of the rail parts 21. Then, as shown in FIG. 9, the guiding projection 25 of the holder 18*c* is inserted into the guiding groove 26 of the holder 18*a*. Then, the other holders 18*c* are press-fit into between the pair of the rail parts 21 in turn. Then, each guiding projection 25 of the holder 18*c* is inserted into the corresponding guiding groove 26, so that the holders 18*c* are movable along the longitudinal direction of the rail part 21.

Further, the other holder 18*b* is press-fit into between the pair of the rail parts 21 so as to engage the engaging projection 23 with the engaging recess 24. Thus, as shown in FIGS. 10 and 11, the connecting part 22 and the holders 18*b*, 18*c* are arranged parallel to one another having a distance therebetween, thereby assembling the rear holder 3. Thus, the assembled rear holder 3 together with the sealing member 4 is assembled to the connector block 7 and press-fit into the outer case 6 together with the connector block 7, thereby being assembled to the connector housing 2. When the rear holder 3 is attached to the connector housing 2, the electric wires 17 are positioned among the holders 18*a*, 18*b* and 18*c*.

Figure 12:
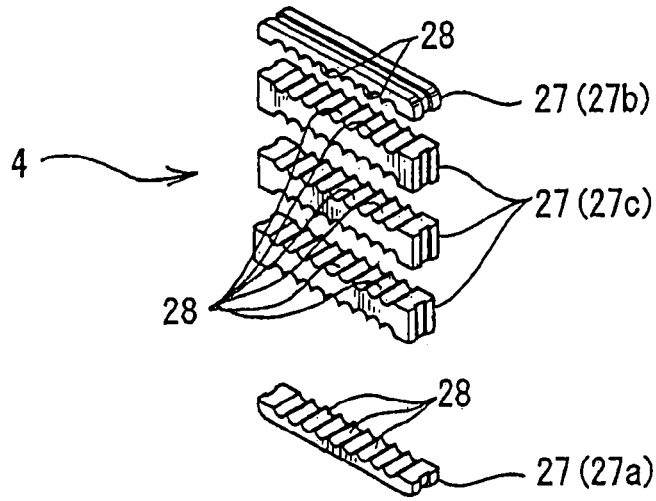
FIG. 12 is an exploded perspective view of a sealing member of the connector shown in FIG. 1.

The sealing member 4 is made of resilient material such as rubber. One sealing member 4 is provided to one connector housing 7. As shown in FIG. 12, the sealing member 4 includes a plurality of the sealing pieces 27. In an example shown in the figure, the sealing member 4 includes five sealing pieces 27.

Each sealing piece 27 is formed in a bar-shape. The sealing pieces 27 are arranged in parallel to one another having a distance therebetween. One sealing piece 27 (hereinafter, 27*a*) situated lowest (i.e. situated at one end) in FIG. 12 among a plurality of the sealing pieces 27 includes a plurality of grooves 28 formed on its surface which faces the other sealing piece 27. Each groove 28 is formed hollow from the surface of the sealing piece 27*a* and in an arc-shape in section. A plurality of the grooves 28 are arranged being lined up along the longitudinal direction of the sealing piece 27*a*. Each groove 28 extends straight along the width direction of the sealing piece 27*a*.

Another sealing piece 27 (hereinafter, 27*b*) situated highest (i.e. situated at an opposite end) in FIG. 12 among a plurality of the sealing pieces 27 includes a plurality of grooves 28 formed on its surface which faces the other sealing piece 27. Each of the other sealing pieces 27 (hereinafter, 27*c*) except the sealing pieces 27*a* and 27*b* includes grooves 28 on its surface (or surfaces) that faces (or face) the other sealing piece and/or its surface that faces the sealing piece 27*a* or 27*b*. The grooves 28 position the electric wires 17, which pass through among the sealing pieces 27*a*, 27*b*, 27*c*, inside.

As for the sealing member 4, by means of an adhesive or the like, two holders 18*a* are attached to the sealing piece 27*a*, two holders 18*b* are attached to the sealing piece 27*b*, and two holders 18*c* are attached to each sealing piece 27*c*. At that time, the sealing pieces 27*a*, 27*b* and 27*c* are positioned between the two respective holders 18*a*, 18*b* and 18*c* along the longitudinal direction of the groove 28. Thus, the sealing pieces 27*a*, 27*b* and 27*c* are attached to the respective holders 18*a*, 18*b* and 18*c*.

As for the sealing member 4, when the other holders 18*c* are piled on the connecting part 22 of the holder 18*a* in turn, the other sealing pieces 27*c* are piled on the sealing piece 27*a* in turn. When the other holder 18*b* is piled on the other holder 18*c* finally, the other sealing piece 27*b* is piled on the sealing piece 27*c*. As for the sealing member 4, when the rear holder 3 is assembled, a plurality of the sealing pieces 27*a*, 27*b* and 27*c* are simultaneously piled in turn, thereby the sealing member 4 is assembled.

Figure 16:
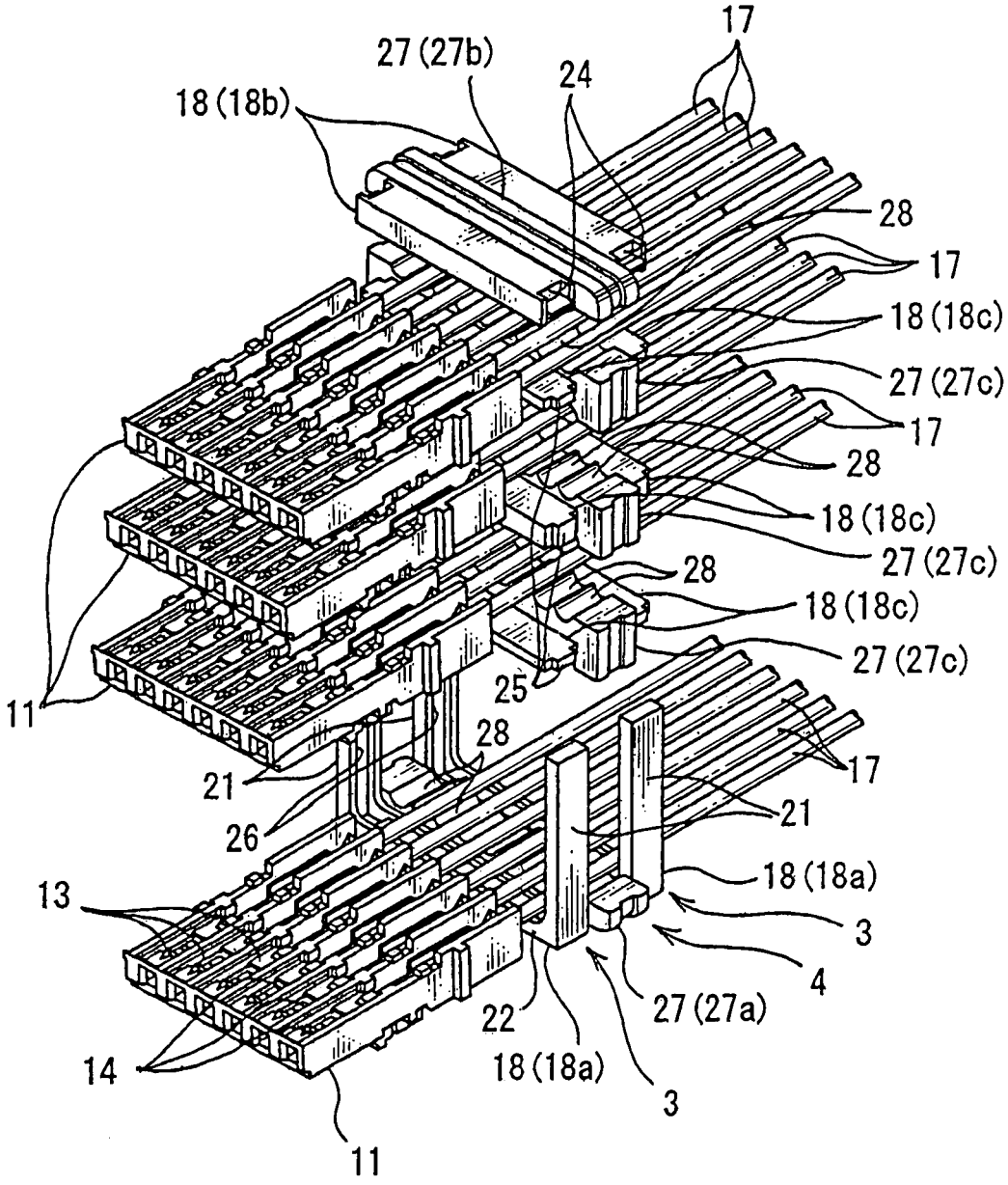
FIG. 16 is a partially exploded perspective view of a connector block of the connector shown in FIG. 1.

At that time, as shown in FIG. 16, the electric wires 17 each attached to the terminal fitting 13, which is received in the terminal receiving groove 14 of the plate-shaped housing 11, are positioned among the sealing pieces 27*a*, 27*b* and 27*c*. Each electric wire 17 is positioned in the corresponding groove 28. The sealing member 4 together with the rear holder 3 is press-fit into the outer case 6 so as to be mounted to the connector housing 2. Thus, when the sealing member 4 is press-fit into the outer case 6 together with the rear holder 3, which is obtained by attaching the holders 18*a*, 18*b* and 18*c* to one another, so as to be mounted to the connector housing 2, the sealing pieces 27*a*, 27*b* and 27*c* are compressed and the sealing member 4 maintains a waterproof characteristic between the sealing member 4 and the electric wires 17 and also maintains a waterproof characteristic between the sealing member 4 and an inner surface of the outer case 6.

As for the connector 1, first, the connector block 7 is assembled and the rear holder 3 and sealing member 4 are assembled to the connector block 7. The terminal fittings 13 each having the electric wire 17 are press-fit into the terminal receiving groove 14 of each plate-shaped housing 11. Thereby, the terminal fittings 13 each having the electric wire 17 are attached to the plate-shaped housing 11.

Figure 13:
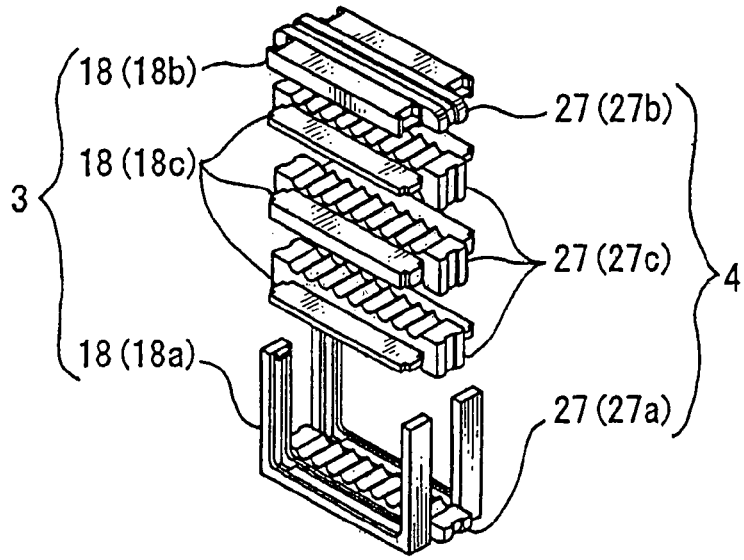
FIG. 13 is a perspective view illustrating a state when the holders of the rear holder shown in FIG. 3 and sealing pieces of the sealing member shown in 12 are attached to one another.
Figure 14:
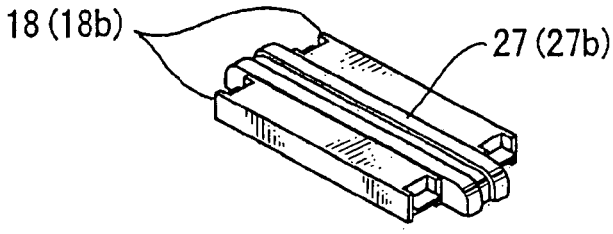
FIG. 14 is a perspective view illustrating another holder and another sealing piece in FIG. 13.
Figure 15:
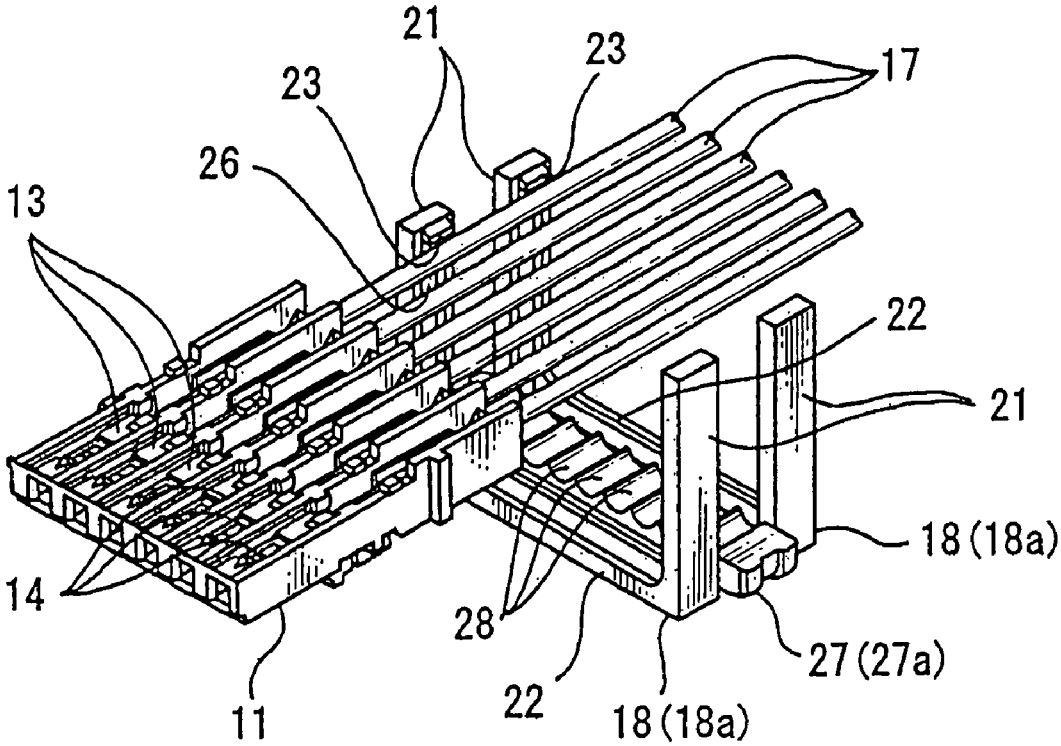
FIG. 15 is a perspective view illustrating one holder and one sealing piece attached to each other shown in FIG. 13 and a plate-shaped housing.

As shown in FIGS. 13 and 14, by means of an adhesive or the like, two holders 18*a* are attached to the sealing piece 27*a*, two holders 18*b* are attached to the sealing piece 27*b*, and two holders 18*c* are attached to each sealing piece 27*c*. Then, as shown in FIG. 15, one plate-shaped housing 11 is assembled to one sealing piece 27*a* and one holder 18*a* in such a manner that the electric wire 17 is piled in the groove 28 of one sealing piece 27*a*. Then, after the sealing piece 27*b* is piled on the electric wire 17 of the one plate-shaped housing 11, the electric wire 17 of the other plate-shaped housing 11 is piled. Thus, as shown in FIG. 1.6, the sealing pieces 27*a*, 27*b* and 27*c* and the plate-shaped housings 11 are piled up alternately one upon another.

Figure 17:
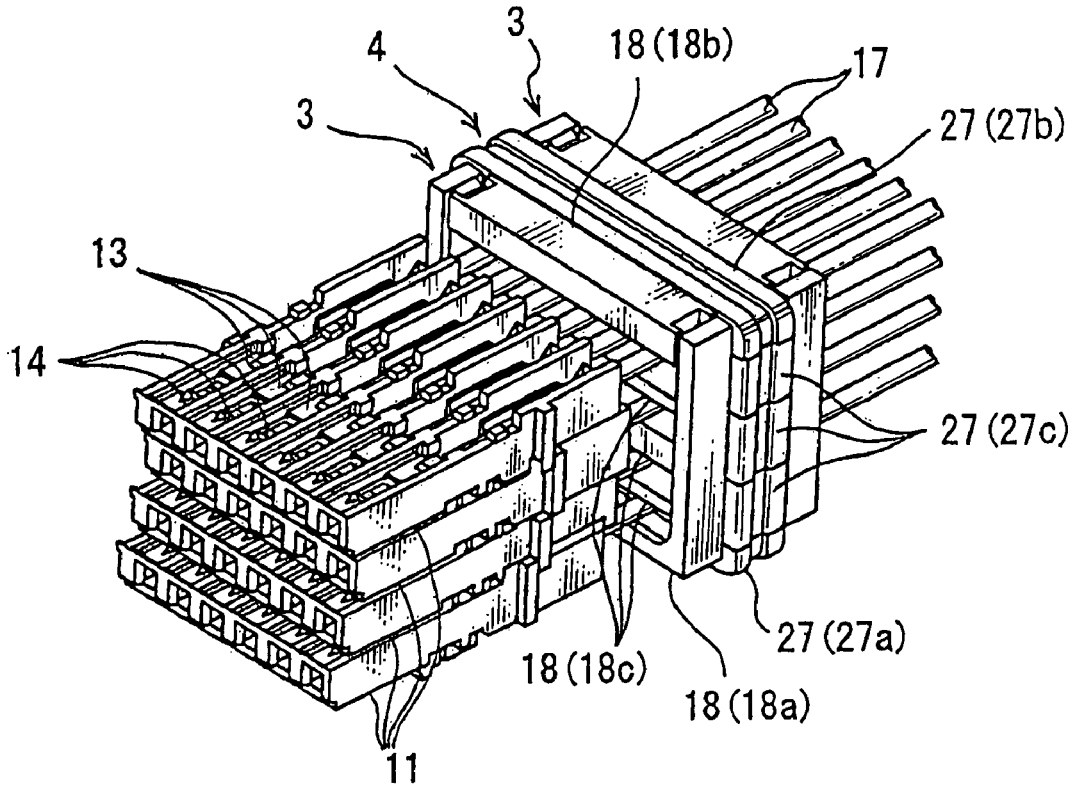
FIG. 17 is a perspective view illustrating a state when the plate-shaped housings of the connector block shown in FIG. 16 are assembled with one another.

Then, the plate-shaped housings 11 are mutually pressed in a direction in which the plate-shaped housings 11 approach each other so as to assemble a plurality of the plate-shaped housings 11 with each other, and the holders 18*a* and 18*b* are fixed to each other by the engaging part 19 so as to assemble the holders 18*a*, 18*b* and 18*c* to one another and to assemble the sealing pieces 27*a*, 27*b* and 27*c* to one another. Then, as shown in FIG. 17, the rear holders 3 and the sealing member 4 are assembled to a plurality of the plate-shaped housings 11, which are assembled to one another. Thereafter, the cover member 12 is assembled to a plurality of the plate-shaped housings 11, which are fixed to one another. Thus, the connector block 7 is assembled and the rear holders 3 and the sealing member 4 are assembled to the connector block 7.

After the connector block 7 is inserted into the housing body 5, the connector block 7, rear holder 3 and sealing member 4 are press-fit into the outer case 6 per housing body 5. Then, the outer case 6 is engaged with the rear holder 3 each other, so that each sealing piece 27*a*, 27*b* or 27*c* of the sealing member 4 maintains a waterproof characteristic between the sealing piece 27*a*, 27*b* or 27*c* and the electric wire 17, thereby the connector 1 is assembled.

The connector 1 assembled as described above is coupled with a mating connector and constructs a wiring harness to be mounted on a motor vehicle and so on.

According to the preferred embodiment as described above, the sealing pieces 27*a*, 27*b* and 27*c* of the sealing member 4 are in advance attached to the respective holders 18*a*, 18*b* and 18*c* made of synthetic resin of the rear holder 3 by an adhesive or the like. Therefore, when the holders 18*a*, 18*b* and 18*c* are assembled to one another, the sealing pieces 27*a*, 27*b* and 27*c* can be prevented from coming off from the holders 18*a*, 18*b* and 18*c* even if resilient force of the sealing piece 27*a*, 27*b* or 27*c* takes place. Therefore, the rear holder 3 can be easily assembled, that is, the connector 1 can be easily assembled.

The other holders 18*c* are slid along the rail part 21 of the one holder 18*a* and further, the other holder 18*b* is engaged with an opposite end of the rail part 21, so that the rear holder 3 can be easily assembled. Therefore, the connector 1 can be easily assembled.

Since the rear holder 3 includes the holders 18*a*, 18*b* and 18*c*, the rear holder 3 can securely position the electric wires 17 among the holders 18*a*, 18*b* and 18*c*. Therefore, the electric wires 17 can be positioned among the sealing pieces 27*a*, 27*b* and 27*c*, so that liquid such as water can be securely prevented from entering into the connector housing 2.

In the preferred embodiment, the sealing pieces 27*a*, 27*b* and 27*c* constituting the sealing member 4 are attached to the holders 18*a*, 18*b* and 18*c* constituting the rear holder 3 by means of an adhesive or the like. However, instead, the sealing pieces 27*a*, 27*b* and 27*c* may be molded integrally with the holders 18*a*, 18*b* and 18*c* by means of insert molding.

Figure 19:
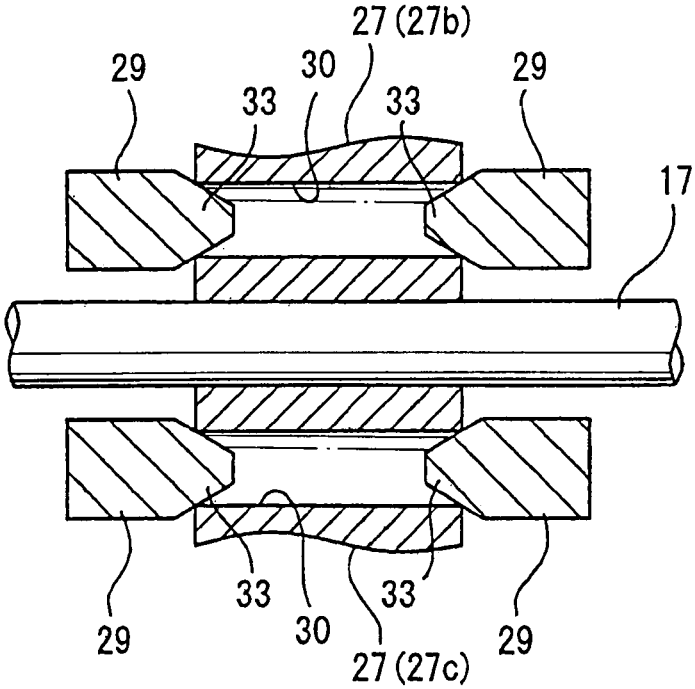
FIG. 19 is a cross sectional view illustrating a state before a reinforcing member and sealing piece shown in FIG. 18 are assembled with each other.
Figure 20:
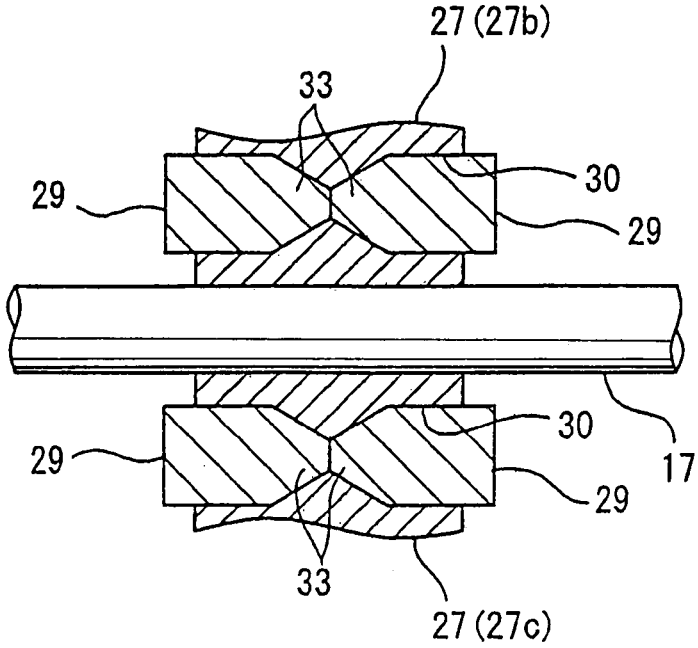
FIG. 20 is a cross sectional view illustrating a state when the reinforcing member and sealing piece shown in FIG. 19 are assembled with each other.

In the following, a connector according to the second preferred embodiment of the present invention will be explained with reference to FIGS. 18-20.

Figure 18:
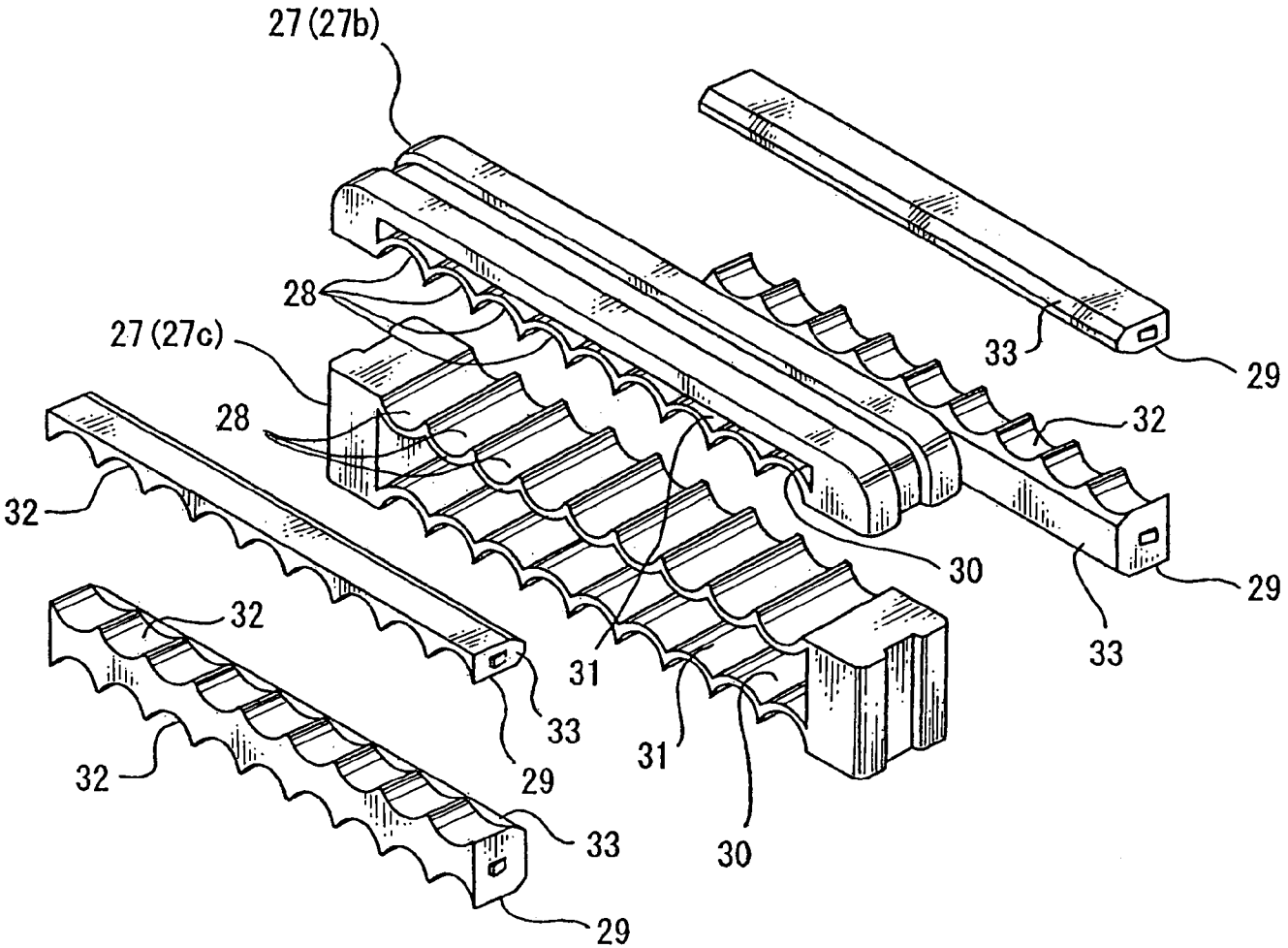
FIG. 18 is an exploded perspective view illustrating a primary part of a connector according to the second preferred embodiment of the present invention.

In the preferred embodiment, as shown in FIG. 18, the sealing member 4 includes a plurality of sealing pieces 27*a*, 27*b* and 27*c* and a reinforcing member 29 made of electrically insulating and hard synthetic resin. The sealing pieces 27*a*, 27*b* and 27*c* each includes a reinforcing member receiving hole 30 as gap parts which penetrate through the respective sealing piece 27*a*, 27*b* or 27*c*, along the longitudinal direction of the groove 28.

The reinforcing member receiving hole 30 is formed over the whole length of each sealing piece 27*a*, 27*b* or 27*c*. Each reinforcing member receiving hole 30 has a semicircular convexo-concave face 31 parallel to the inner surface of the groove 28 on a face of the reinforcing member receiving hole 30. The semicircular convexo-concave face 31 is formed in such a manner that a plurality of convex parts having an arc-shape in section are formed toward the inside of the reinforcing member receiving hole 30 along the longitudinal direction of the sealing piece 27*a*, 27*b* or 27*c*. Also, the semicircular convexo-concave face 31 is formed in such a manner that a thickness of a base material of the sealing piece 27*a*, 27*b* or 27*c* between the inner face of the groove 28 and the reinforcing member receiving hole 30 is constant.

Two reinforcing members 29 are provided to one sealing piece 27*a*, 27*b* or 27*c*. These two reinforcing members 29 have the same shape. The reinforcing member 29 is formed along an inner shape of the semicircular convexo-concave face 31, that is, along an inner shape of the groove 28. The reinforcing member 29 includes: a semicircular convexo-concave part 32 that is parallel to the inner face of the groove 28 and closely comes in contact with the semicircular convexo-concave face 31, that is, closely comes in contact with the sealing piece 27*a*, 27*b* or 27*c* when the reinforcing members 29 are press-fit into the reinforcing member receiving hole 30; and a tapered part 33. The maximum thickness of the reinforcing member 29 is larger than the thickness of the reinforcing member receiving hole 30.

The tapered part 33 is formed over the whole length of the reinforcing member 29 in its longitudinal direction and makes the reinforcing member 29 gradually thin along the width direction of the reinforcing member 29. As shown in FIG. 19, the two reinforcing members 29 are press-fit into the reinforcing member receiving hole 30 from the side of the tapered part 33. As shown in FIG. 20, the reinforcing members 29 are received in the reinforcing member receiving hole 30, so that an outer surface of the reinforcing member 29 is flush with the surface of the sealing piece 27*a*, 27*b* or 27*c*. Thus, the reinforcing members 29 are press-fit into the reinforcing member receiving hole 30 so as to be embedded in the reinforcing member receiving hole 30 as the gap part of the sealing piece 27*a*, 27*b* or 27*c*.

In the preferred embodiment, since the reinforcing members 29 are embedded in the respective sealing pieces 27*a*, 27*b* and 27*c*, therefore the sealing pieces 27*a*, 27*b* and 27*c* are hardly deformed resiliently (i.e. being hardened), so that a waterproof characteristic between the sealing piece 27*a*, 27*b* or 27*c* and the electric wire 17 can be securely maintained. Therefore, liquid such as water can be securely prevented from entering into the connector 1.

Since the reinforcing member 29 is provided with the semicircular convexo-concave part 32 that is parallel to the inner face of the groove 28 of the sealing piece 27*a*, 27*b* or 27*c*, therefore force that the inner face of the groove 28 of the sealing piece 27*a*, 27*b* or 27*c* presses the electric wire 17 is uniform in the circumferential direction of the groove 28. Therefore, a waterproof characteristic between the sealing piece 27*a*, 27*b* or 27*c* and the electric wire 17 can be more securely maintained. Therefore, liquid such as water can be securely prevented from entering into the connector 1.

Further, since the reinforcing members 29 are press-fit into the reinforcing member receiving hole 30 so as to be attached to the respective sealing pieces 27*a*, 27*b* and 27*c*, therefore the reinforcing members 29 can be securely embedded in the respective sealing pieces 27*a*, 27*b* and 27*c*. Therefore, the sealing pieces 27*a*, 27*b* and 27*c* can be securely hardened. Therefore, a waterproof characteristic between the sealing piece 27*a*, 27*b* or 27*c* and the electric wire 17 can be securely maintained.

Figure 21:
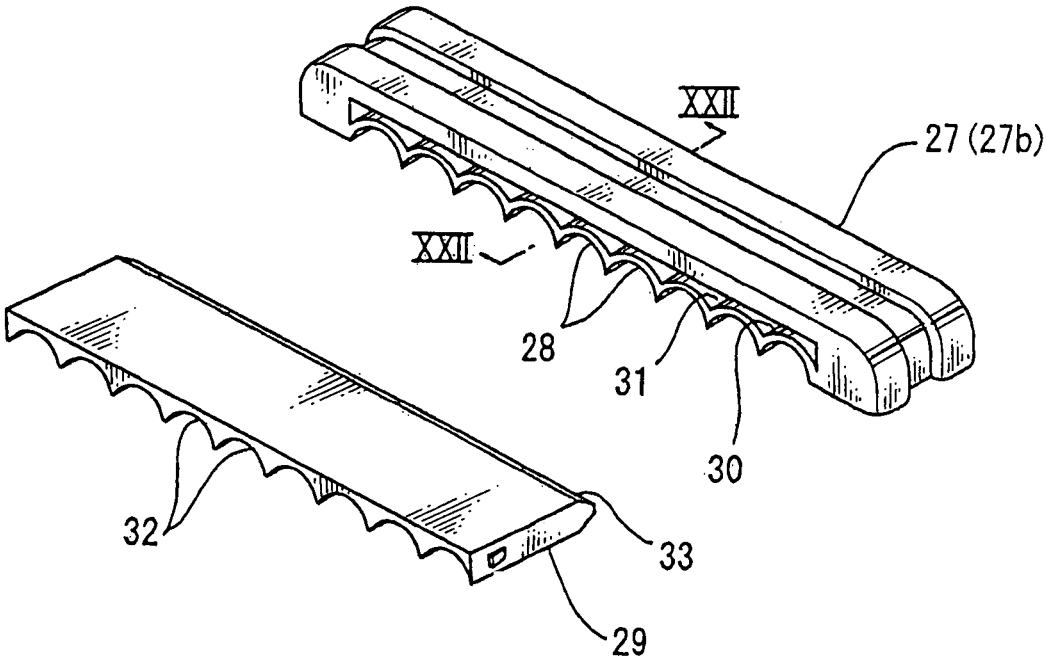
FIG. 21 is an exploded perspective view illustrating a primary part of a modified example of the connector shown in FIG. 18.
Figure 22:
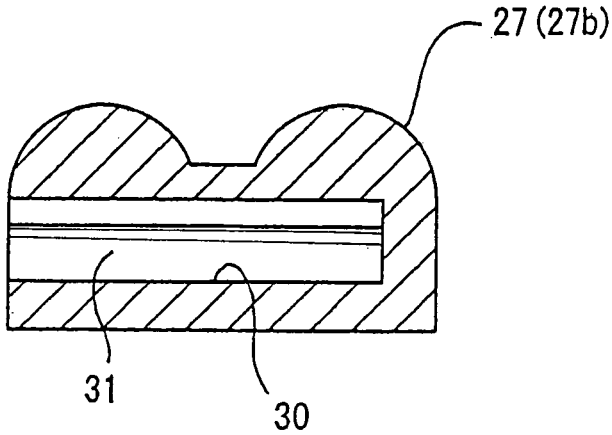
FIG. 22 is a cross sectional view taken along XXII-XXII line in FIG. 21.

In the preferred embodiment, as shown in FIG. 21, one reinforcing member 29 may be provided to one sealing piece 27*a*, 27*b* or 27*c*. In this case, as shown in FIG. 22, the reinforcing member receiving hole 30 may not penetrate through the sealing piece 27*a*, 27*b* or 27*c*.

Figure 23:
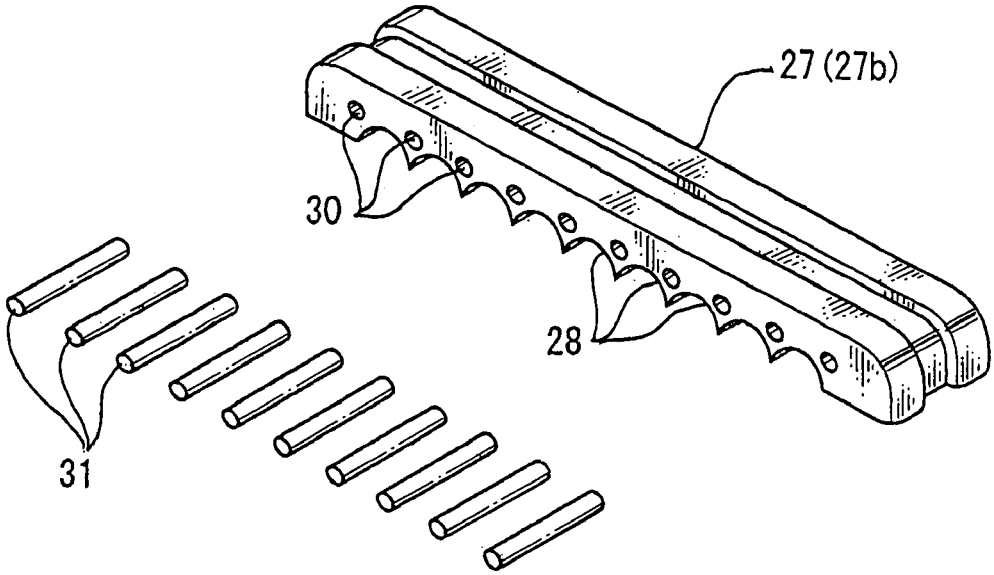
FIG. 23 is an exploded perspective view illustrating a primary part of another modified example of the connector shown in FIG. 18.

Further, in the preferred embodiment, the reinforcing member receiving hole 30 may not be provided with the semicircular convexo-concave face 31, and the reinforcing member 29 may not be provided with the semicircular convexo-concave part 32. For example, as shown in FIG. 23, the reinforcing member 29 may be formed in a tube-shape, and the reinforcing member receiving hole 30 may be formed to be a hole having a round shape in section. That is, the reinforcing member 29 may have various shapes provided that the reinforcing member 29 is made of hard synthetic resin (hard material).

Figure 24:
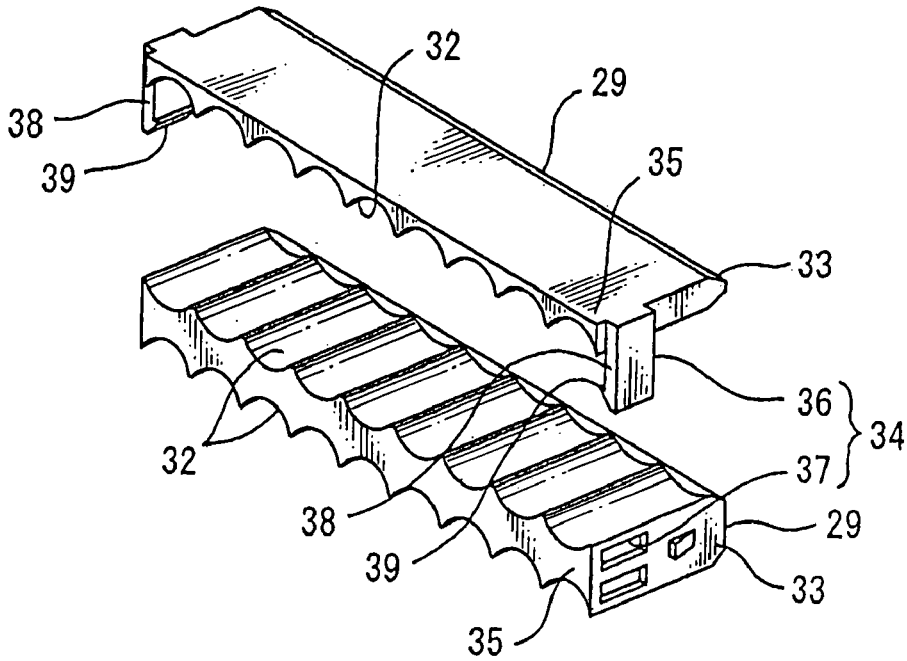
FIG. 24 is an exploded perspective view illustrating a primary part of a further modified example of the connector shown in FIG. 18.

In the preferred embodiment, as shown in FIG. 24, the sealing member 4 of the connector 1 may be provided with a fixing part 34 for fixing the reinforcing members 29 to each other. In an example shown in the figure, each reinforcing member 29 is provided with a projection part 35 projecting outside the sealing piece 27*a*, 27*b* or 27*c* when the reinforcing member 29 is press-fit into the reinforcing member receiving hole 30. The fixing part 34 includes a locking arm 36 provided to one of the two reinforcing members 29 fixed to each other and a locking recess 37 provided to another of the two reinforcing members 29.

The pair of the locking arms 36 is formed at both ends of the reinforcing member 29 in the longitudinal direction. The locking arm 36 includes: an arm body 38 extending from one reinforcing member 29 to another reinforcing member 29; and a locking projection 39 formed at an end of the arm body 38, said end being situated away from the one reinforcing member 29 out of the two reinforcing members 29. The locking projection 39 projects in a direction in which the locking arms 36 approach each other from an end of the arm body 38.

The locking recess 37 is provided at both ends of the other reinforcing member 29 in the longitudinal direction and formed hollow from an end face of the reinforcing member 29. When the locking projections 39 of the locking arms 36 enter into the respective locking recesses 37, the fixing part 34 fixes the two reinforcing members 29 to each other.

In this case, since the sealing member 4 includes the fixing part 34 for fixing the two reinforcing members 29 to each other, therefore the fixing part 34 maintains distances among the sealing pieces 27*a*, 27*b* and 27*c* always constant. Accordingly, the distances among the sealing pieces 27*a*, 27*b* and 27*c* can be prevented from changing largely from predetermined distances. Therefore, a waterproof characteristic between the sealing pieces 27*a*, 27*b* and 27*c* and the electric wires 17 can be more securely maintained, and liquid such as water can be more securely prevented from entering into the connector 1.

Figure 25:
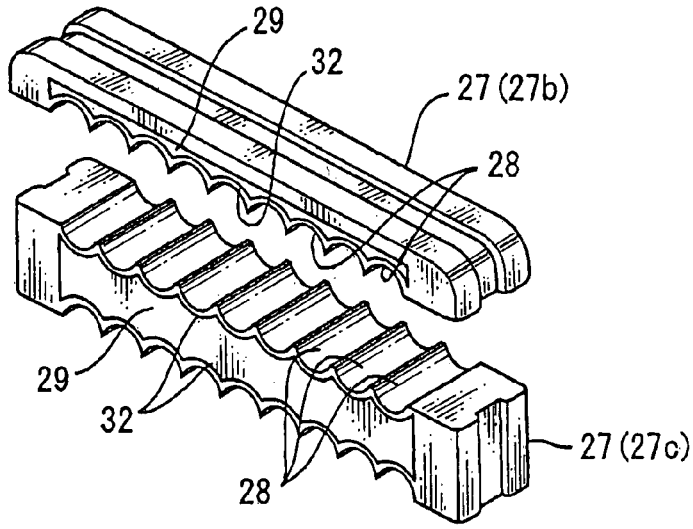
FIG. 25 is an exploded perspective view illustrating a primary part of a further modified example of the connector shown in FIG. 18.
Figure 26:
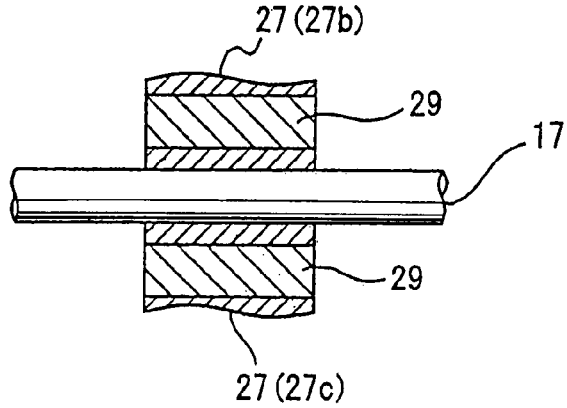
FIG. 26 is a cross sectional view of a sealing piece of the connector shown in FIG. 25.
Figure 27:
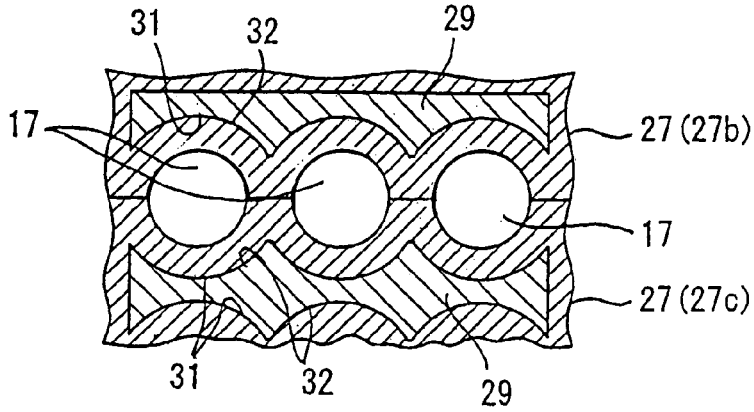
FIG. 27 is another cross sectional view of a sealing piece of the connector shown in FIG. 25.

Further, in the preferred embodiment, by means of insert molding, as shown in FIGS. 25-27, the reinforcing member 29 and the sealing piece 27*a*, 27*b* or 27*c* may be integrally molded in advance so that the reinforcing member 29 is embedded in the sealing piece 27*a*, 27*b* or 27*c*.

In the preferred embodiment described above, the rail part 21 is provided with the engaging projection 23, and the holder 18*b* is provided with the engaging recess 24. However, instead, the holder 18*b* may be provided with the engaging projection 23, and the rail part 21 may be provided with the engaging recess 24. In the preferred embodiment described above, the holder 18*b* is provided with the guiding projection 25, and the rail part 21 is provided with the guiding groove 26. However, instead, the holder 18*b* may be provided with the guiding groove 26, and the rail part 21 may be provided with the guiding projection 25.

In the following, a connector according to the third preferred embodiment of the present invention will be explained with reference to FIGS. 28-34.

Figure 28:
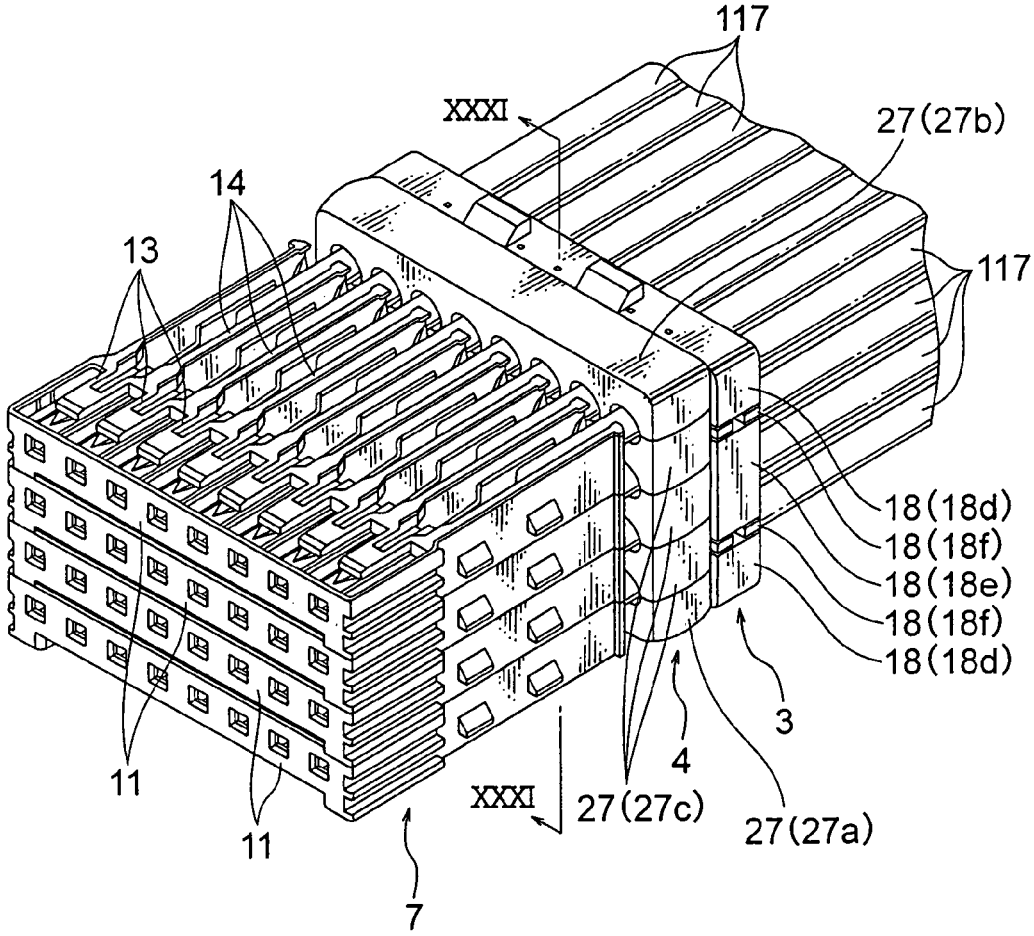
FIG. 28 is a perspective view illustrating a connector block, rear holder and sealing member of a connector according to the third preferred embodiment of the present invention.
Figure 29:
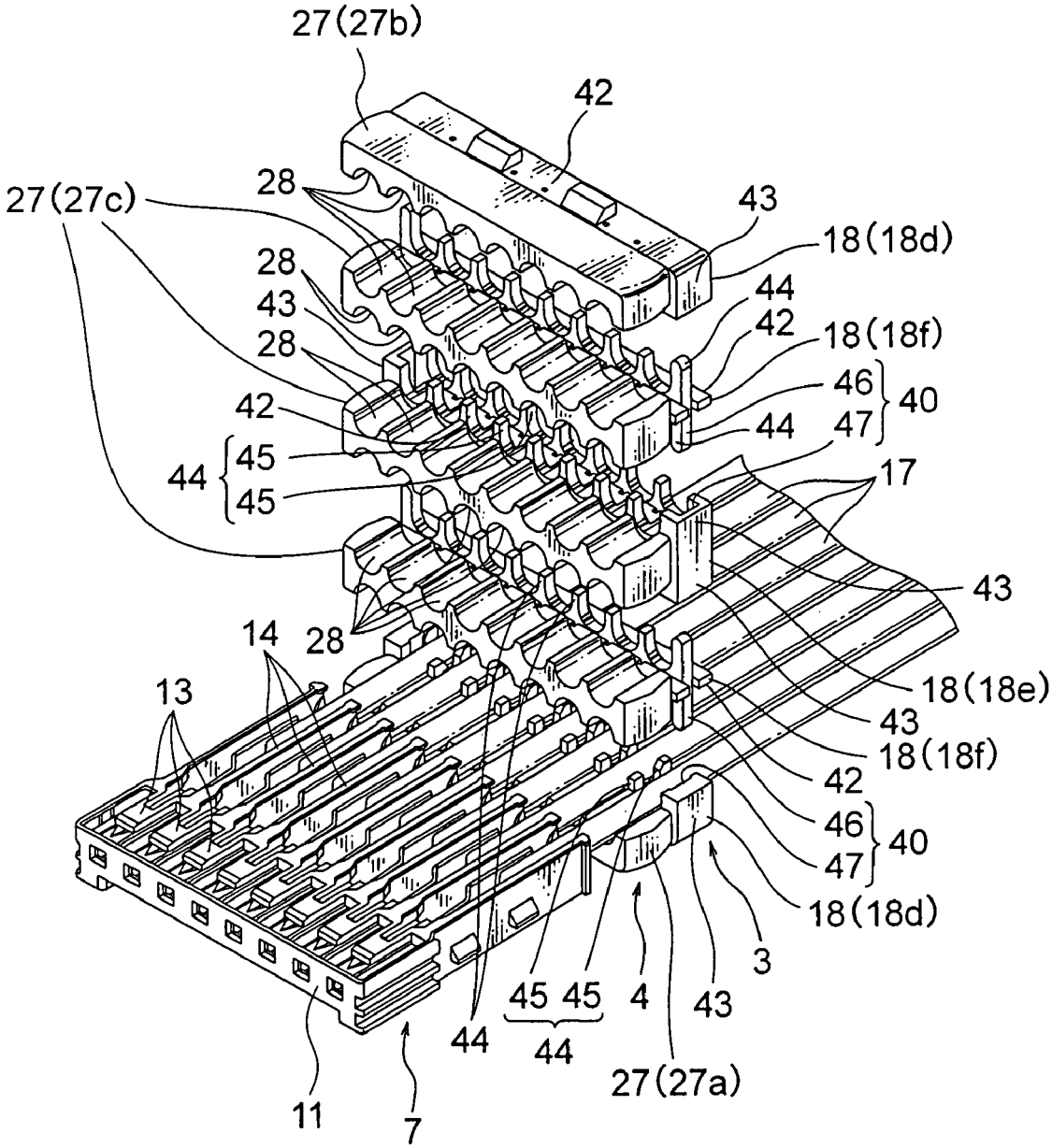
FIG. 29 is an exploded perspective view illustrating the rear holder and sealing member shown in FIG. 28.

As shown in FIGS. 28 and 29, in this preferred embodiment, one connector block 7 attaches one rear holder 3 and one sealing member 4. The rear holder 3 includes: a plurality of holders 18 made of hard synthetic resin and piled up with one another; a positioning part 40 as a holder positioning means; and a fixing part 41 as a holder fixing means. In an example shown in the figure, the rear holder 3 includes five holders 18.

Figure 30:
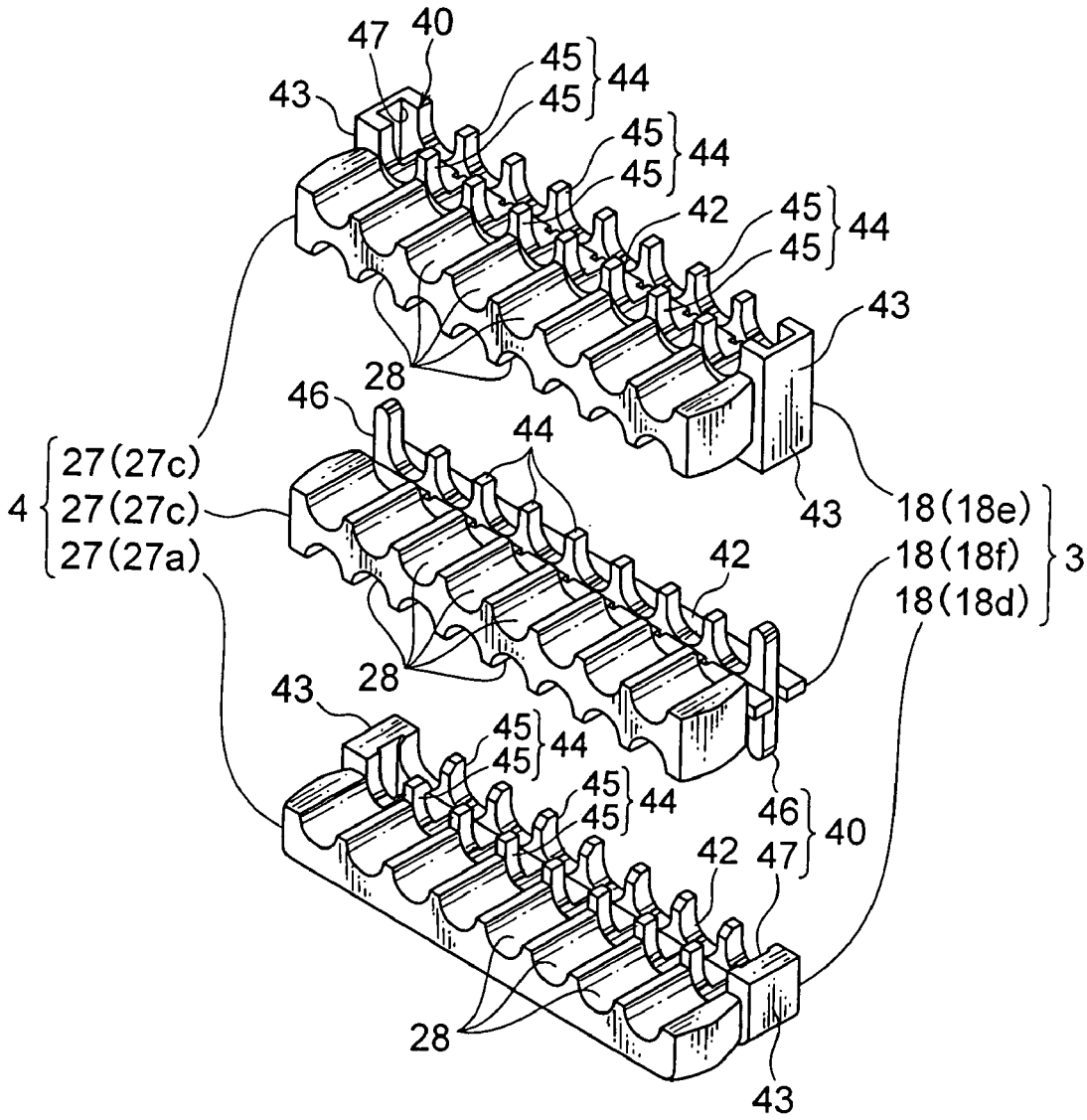
FIG. 30 is an enlarged perspective view illustrating holders of the rear holder and sealing pieces of the sealing member shown in FIG. 29.

When a plurality of the holders 18 are piled up with one another, two holders 18 (hereinafter, 18*d*) situated at both ends of a plurality of the holders 18 piled up with one another are formed in the same shape and as shown in FIG. 30, each includes: a bar-shaped body part 42; a pair of side plates 43 standing up from both ends of the body part 42 in the longitudinal direction; and a plurality of partitioning parts 44. The partitioning parts 44 stand up from the body part 42 in the same direction as that of the pair of side plates 43 and are arranged between the side plates 43 having the same distance therebetween. The partitioning parts 44 position the electric wires 17 therebetween. Each partitioning part 44 includes a pair of standing-up bars 45 arranged along the longitudinal direction of the electric wire 17 having a distance therebetween.

When a plurality of the holders 18 are piled up with one another, as shown in FIG. 30, one holder 18 (hereinafter, 18*e*) situated at the center of a plurality of the holders 18 piled up with one another includes: a bar-shaped body part 42; two pairs of side plates 43 standing up from both ends of the body part 42 in both directions; and a plurality of partitioning parts 44. The partitioning parts 44 stand up from the body part 42 in the same direction as that of the two pairs of side plates 43 and are arranged between the side plates 43 having the same distance therebetween. The partitioning parts 44 position the electric wires 17 therebetween. Each partitioning part 44 includes a pair of standing-up bars 45 arranged along the longitudinal direction of the electric wire 17 having a distance therebetween.

Further, as shown in FIG. 30, each of two holders 18 (hereinafter, 18*f*) arranged between the holder 18*d* and the holder 18*e* includes a bar-shaped body part 42 and a plurality of partitioning parts 44. The partitioning parts 44 stand up from the body part 42 in both directions and arranged along the longitudinal direction of the body part 42. The partitioning parts 44 position the electric wires 17 therebetween.

Figure 33:
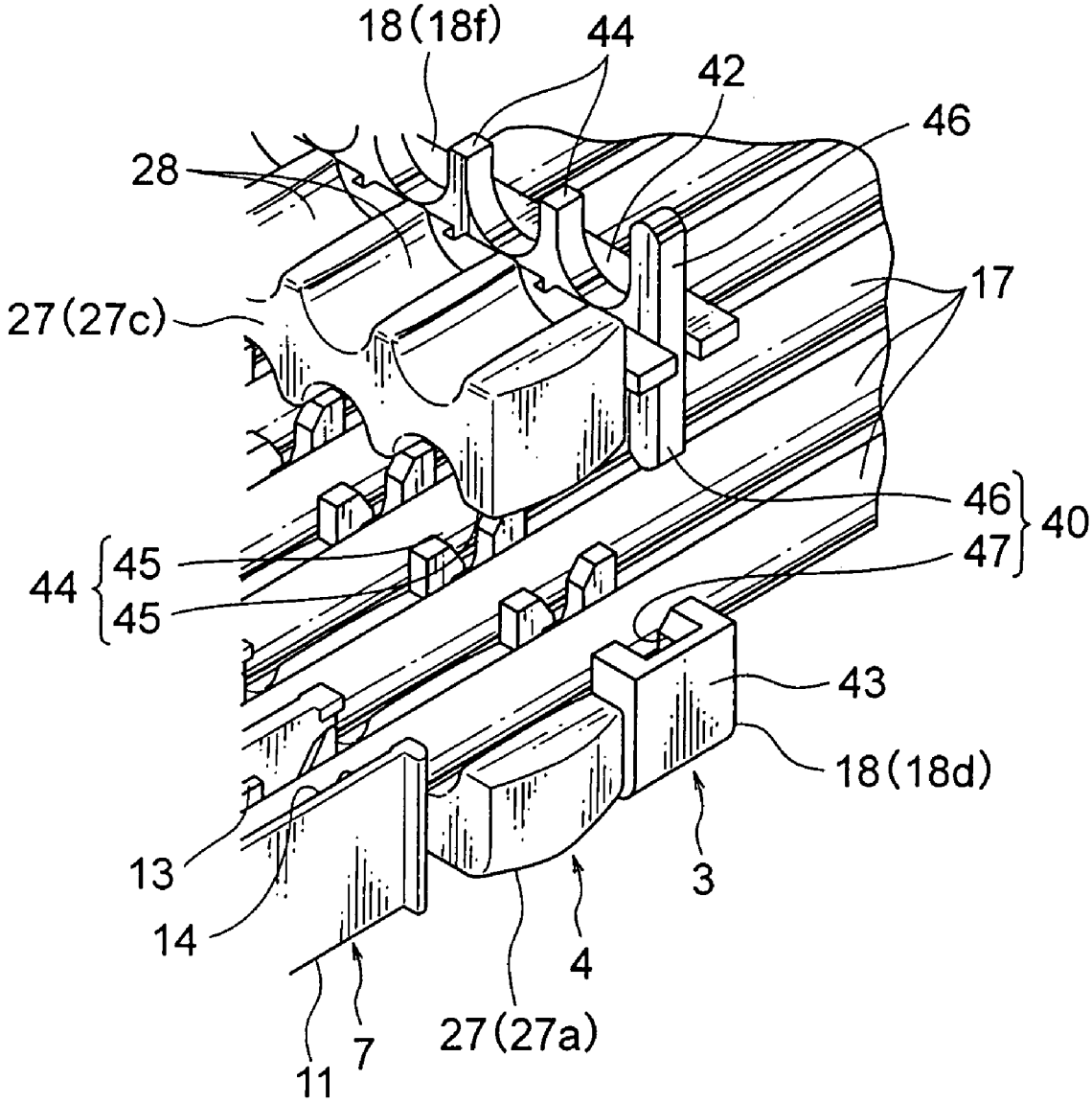
FIG. 33 is an enlarged perspective view of a primary part of the rear holder and sealing member shown in FIG. 29.
Figure 34:
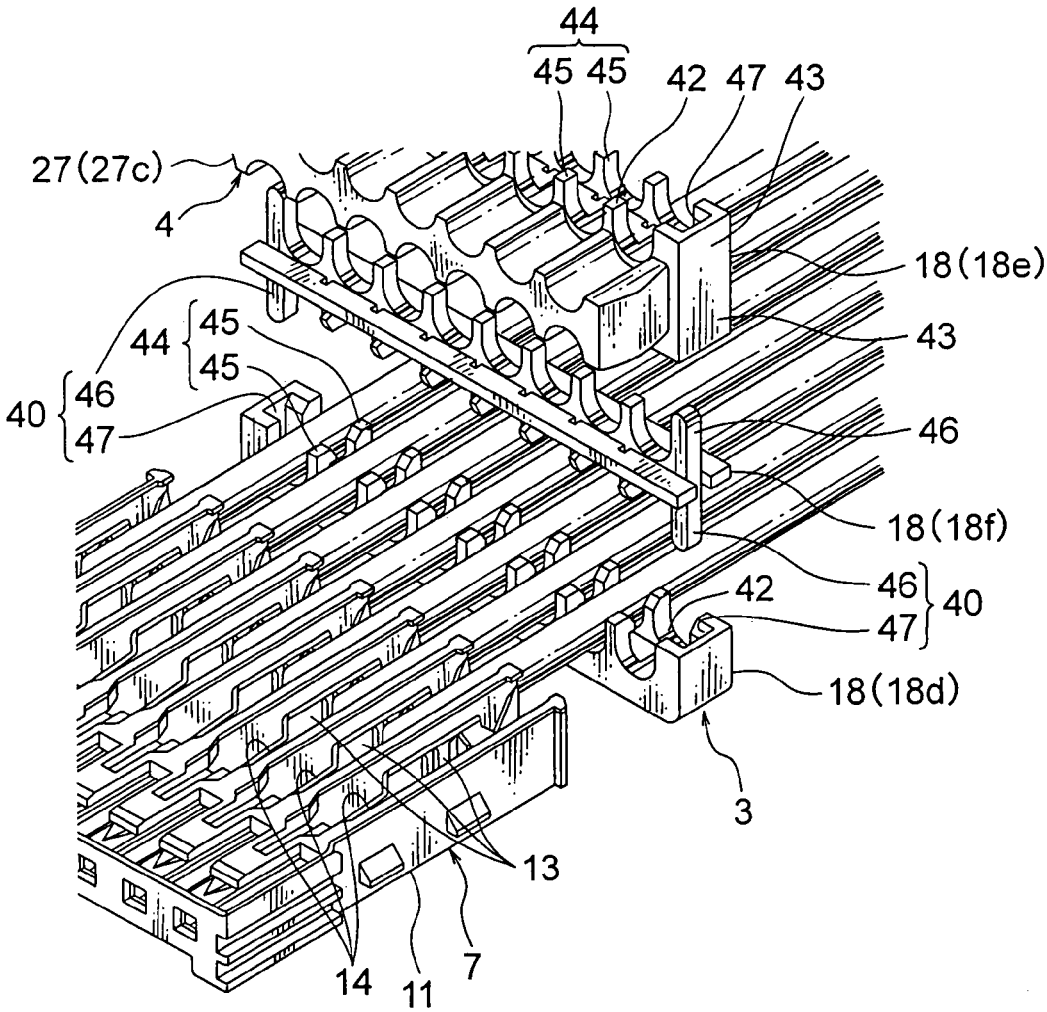
FIG. 34 is an enlarged perspective view of a primary part of the rear holder shown in FIG. 33.

As shown in FIGS. 33 and 34, the positioning part 40 includes: a positioning bar 46 projecting toward the holder 18*d*, 18*e* from both ends of the holder 18*f* in the longitudinal direction; and a positioning hole 47 formed in a side plate 43 of the holder 18*d*, 18*e*. When the positioning bars 46 enter into the respective positioning holes 47, the positioning part 40 positions the holders 18*d*, 18*e* and 18*f* piled up with one another.

Figure 31:
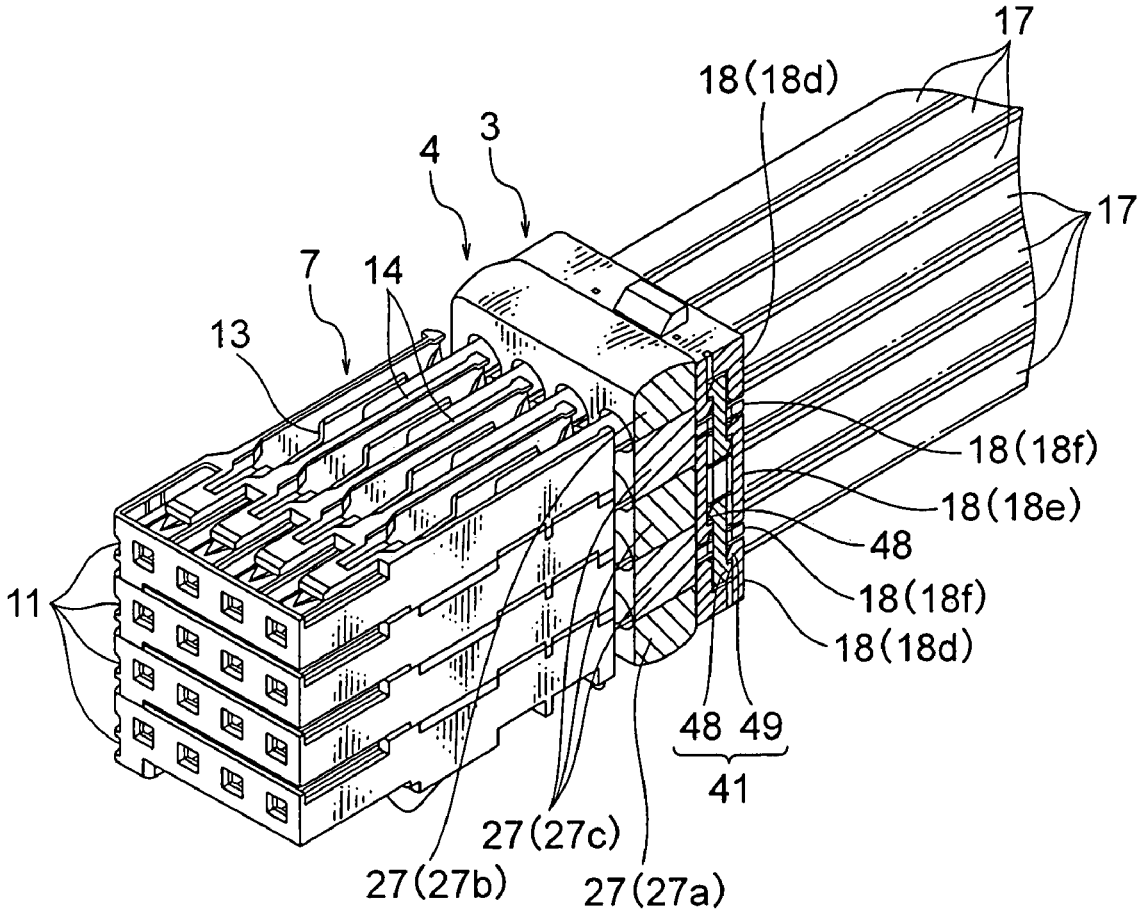
FIG. 31 is a perspective view illustrating a cross section taken along XXXI-XXXI line in FIG. 28.
Figure 32:
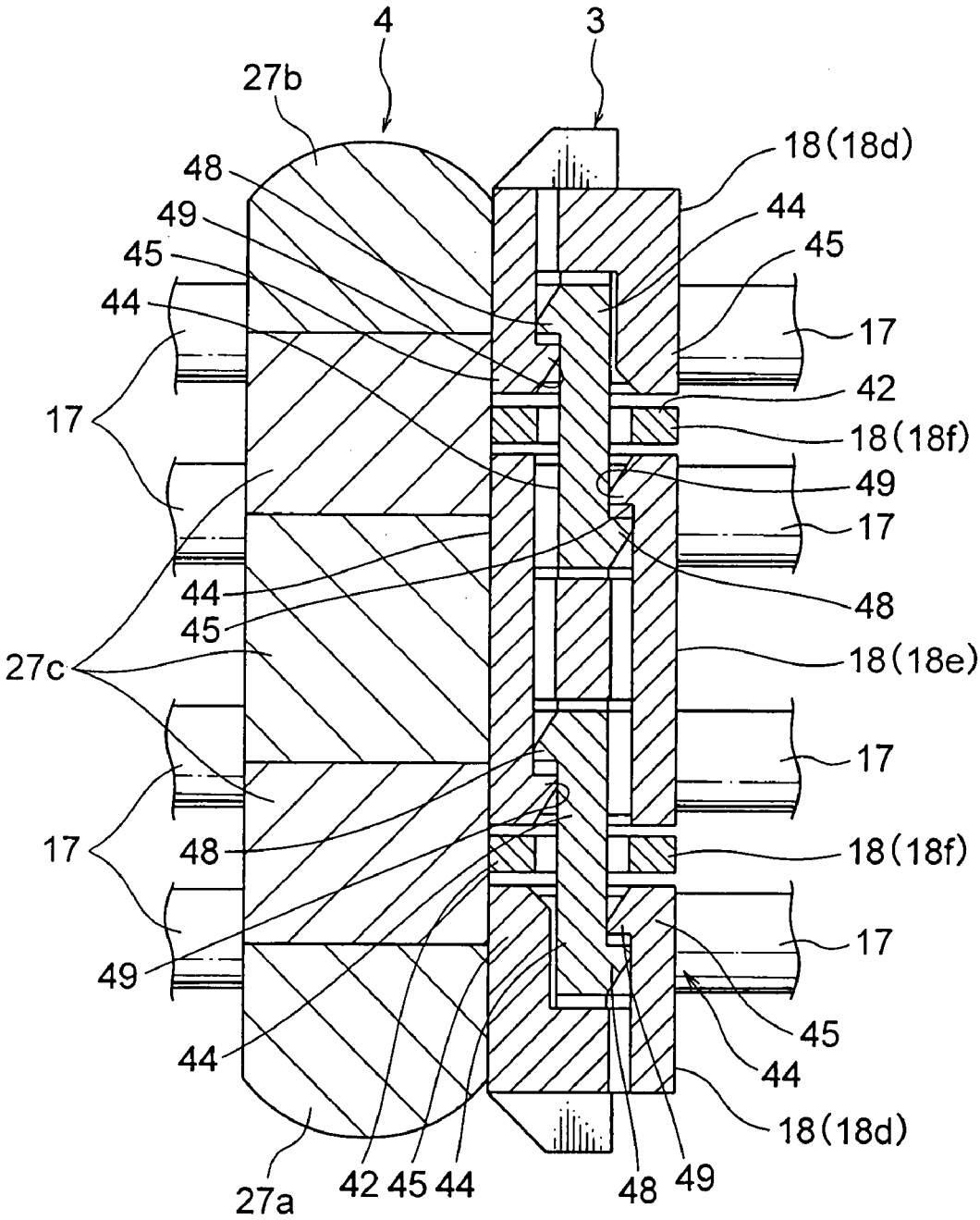
FIG. 32 is an enlarged cross sectional view of the cross section shown in FIG. 31.

As shown in FIGS. 31 and 32, the fixing part 41 includes: a locking claw 48 formed at an end of the partitioning part 44 of the holder 18*f*, said end being situated away from the body part 42; and a locking claw 49 engaging with the locking claw 48 and provided to a standing-up bar 45 of the partitioning part 44 of the holder 18*d*, 18*e*. When the locking claws 48 and 49 engage with each other, the fixing part 41 fixes the holders 18*d*, 18*e* and 18*f* piled up with one another with each other.

The holders 18*d*, 18*f*, 18*e*, 18*f*, and 18*d* are laminated (i.e. piled up) in turn, so that the rear holder 3 is assembled. At that time, of course, the positioning bars 46 enter into the respective positioning holes 47 and the locking projections 48 and 49 engage with each other. The rear holder 3 is assembled to the connector block 7 together with the sealing member 4 on a condition that the holders 18*d*, 18*e* and 18*f* position the electric wires 17 therebetween and assembled to the connector housing 2.

In FIG. 31, the sealing member 4 includes five sealing pieces 27 similarly to the first preferred embodiment. The sealing pieces 27*a* and 27*b* are attached to the respective holders 18*d* by an adhesive, and the sealing pieces 27*c* are attached to the respective holders 18*e* and 18*f* by an adhesive. When the sealing member 4 is assembled to the connector block 7 together with the rear holder 3, the sealing member 4 positions the electric wires 17 among the sealing pieces 27*a*, 27*b* and 27*c* and positions the electric wires 17 in the grooves 28.

In the third preferred embodiment, similarly to the first and second preferred embodiments, the sealing pieces 27*a*, 27*b* and 27*c* of the sealing member 4 are in advance attached to the respective holders 18*d*, 18*e* and 18*f* made of synthetic resin of the rear holder 3 by an adhesive or the like. Therefore, when the holders 18*d*, 18*e* and 18*f* are assembled to one another, the sealing pieces 27*a*, 27*b* and 27*c* can be prevented from coming off from the holders 18*d*, 18*e* and 18*f* even if resilient force of the sealing piece 27*a*, 27*b* or 27*c* takes place. Therefore, the rear holder 3 can be easily assembled, that is, the connector 1 can be easily assembled.

Further, since the rear holder 3 includes the positioning part 40 for positioning the holders 18*d*, 18*e* and 18*f* with one another, the positioning part 40 maintains the positional relation among the holders 18*d*, 18*e* and 18*f*, that is, among the sealing piece 27*a*, 27*b* or 27*c* always constant. Therefore, a waterproof characteristic between the sealing pieces 27*a*, 27*b* and 27*c* and the electric wires 17 can be securely maintained, and liquid such as water can be more securely prevented from entering into the connector 1.

Further, since the rear holder 3 includes the fixing part 41 for fixing the holders 18*d*, 18*e* and 18*f* to one another, therefore the holders 18*d*, 18*e* and 18*f* can be securely fixed to each other by the fixing part 41, that is, the sealing piece 27*a*, 27*b* or 27*c* can be securely fixed to each other by the fixing part 41. Therefore, a waterproof characteristic between the sealing pieces 27*a*, 27*b* and 27*c* and the electric wires 17 can be securely maintained, and liquid such as water can be more securely prevented from entering into the connector 1.

In the third preferred embodiment, similarly to the first preferred embodiment, a plurality of rear holders 3 may be attached to one connector block 7. The holders 18*d*, 18*e* and 18*f* and the sealing pieces 27*a*, 27*b* and 27*c* may be integrally molded by means of insert molding. Similarly to the second preferred embodiment, the reinforcing members 29 may be embedded in the respective sealing pieces 27*a*, 27*b* and 27*c*, and the sealing member 4 may be provided with a fixing part 34 for fixing the reinforcing members 29 to each other.

The aforementioned preferred embodiments are described to aid in understanding the present invention and variations may be made by one skilled in the art without departing from the spirit and scope of the present invention.

What is claimed is:

1. A connector comprising:

a connector housing for receiving terminal fittings;

a rear holder which includes a plurality of holders made of synthetic resin for positioning an electric wire attached to the terminal fitting between the holders, the rear holder being mounted to the connector housing when the holders are attached to one another; and a sealing member which includes a plurality of sealing pieces made of resilient material for positioning the electric wire between the sealing pieces, the sealing member maintaining a waterproof characteristic between the sealing member and the electric wires when the holders are attached to the respective sealing pieces, the holders are attached to one another, and the rear holder is mounted to the connector housing.

2. The connector according to claim 1, wherein a holder base positioned at an end of the rear holder and a laminated holder to be laminated on the holder base are provided as the holders.

3. The connector according to claim 2, wherein the holder base includes a connecting part and a rail part projecting in a laminating direction of the laminated holder from both ends of the connecting part, while the rear holder includes a guiding part which allows the laminated holder to be movable along a longitudinal direction of the rail part.

4. The connector according to claim 3, wherein the rear holder includes an engaging part for engaging an end part of the rail part with a laminated holder, said end part being situated away from the connecting part, and said laminated holder being situated farthest away from the connecting part among the laminated holders.

5. The connector according to claim 1, wherein the sealing member includes: a plurality of the sealing pieces; and reinforcing members each made of synthetic resin and embedded in a cavity formed in the sealing piece.

6. The connector according to claim 5, wherein the sealing piece includes a groove having a semicircular shape in cross section for positioning an electric wire inside, the reinforcing member includes a groove-shaped part formed in accordance with an inner shape of the groove, and the groove-shaped part is parallel to an inner surface of the groove so as to closely come in contact with the sealing piece when the reinforcing member is press-fit into the cavity.

7. The connector according to claim 5, wherein the reinforcing member is integrally formed with the sealing piece.

8. The connector according to claim 5, wherein the sealing member includes a fixing part for fixing the reinforcing members to each other.

9. The connector according to claim 1, wherein the rear holder includes a holder positioning means for positioning the holders piled up with one another.

10. The connector according to claim 1, wherein the rear holder includes a holder fixing means for fixing the holders piled up with one another.

* * * * *